United States Patent [19]

Greaves et al.

[11] 4,050,592

[45] Sept. 27, 1977

[54] CHARGING APPARATUS FOR SHAFT FURNACES

[75] Inventors: Melvin J. Greaves, Cleveland; Frank V. Razgaitis, Seven Hills, both of Ohio

[73] Assignee: Arthur G. McKee & Company, Cleveland, Ohio

[21] Appl. No.: 701,954

[22] Filed: July 1, 1976

Related U.S. Application Data

[60] Division of Ser. No. 604,328, Aug. 13, 1975, which is a continuation of Ser. No. 411,924, Nov. 1, 1973, abandoned.

[51] Int. Cl.[2] ..... C21B 7/20

[52] U.S. Cl. ..... 214/18.2

[58] Field of Search ..... 214/18.2, 36, 37, 152; 266/184; 340/246; 200/61.21

[56] References Cited

U.S. PATENT DOCUMENTS

| | | | |
|---|---|---|---|
| 864,053 | 8/1907 | Witherbee et al. | 214/37 X |
| 1,996,784 | 4/1935 | Zimmerman | 266/184 X |
| 2,563,681 | 8/1951 | Johnson et al. | 214/36 |
| 3,476,268 | 11/1969 | Munson | 214/18.2 X |
| 3,706,387 | 12/1972 | Tokarz | 214/37 |

*Primary Examiner*—Robert G. Sheridan
*Attorney, Agent, or Firm*—Bosworth, Sessions & McCoy

[57] ABSTRACT

Apparatus for charging material into a shaft furnace, such as a blast furnace. The apparatus includes gas lock means for introducing charge material into the furnace while the furnace is under gas pressure, and distributor means below the gas lock means that causes charge material to be deposited and distributed in the upper portion or throat of the furnace either toward the outer periphery of the cross section in the furnace bounded by the interior surface of the furnace wall or toward the center of such cross section, or in both places, to provide an upper surface or stockline of charge material that is essentially level or of any other desired shape within substantial limits. One form of distributor means disclosed comprises a vertically movable distributor bell with an upwardly and inwardly converging top surface that is positioned with the lower edge of such surface positioned either above or below the bottom edge of an opening, larger than the bell diameter, in a distributor hopper with upwardly outwardly diverging sides, so that the material charged into the hopper through the gas lock means can by cooperation of the bell and hopper be deflected either toward the outer periphery or toward the center of the cross section within the furnace or toward any intermediate location, by disclosed positioning or movement of the bell.

Disclosed apparatus also includes means for sensing the level of the stock line at a plurality of locations around the outer periphery of the stockline near the furnace wall, and also at a central location; and means for reversing movement of the bell in case of jamming by an obstruction. Processes carried out by such forms of apparatus are also disclosed.

15 Claims, 40 Drawing Figures

FIG. 2
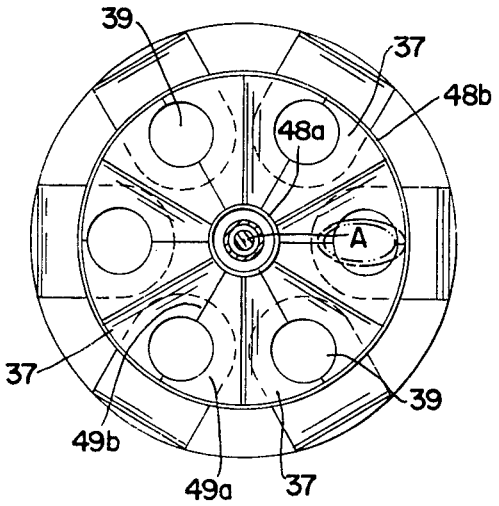
FIG. 4
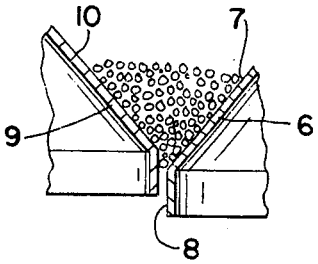
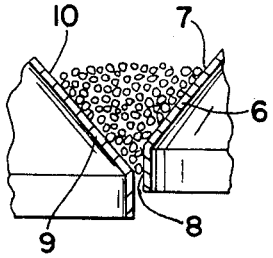
FIG. 3
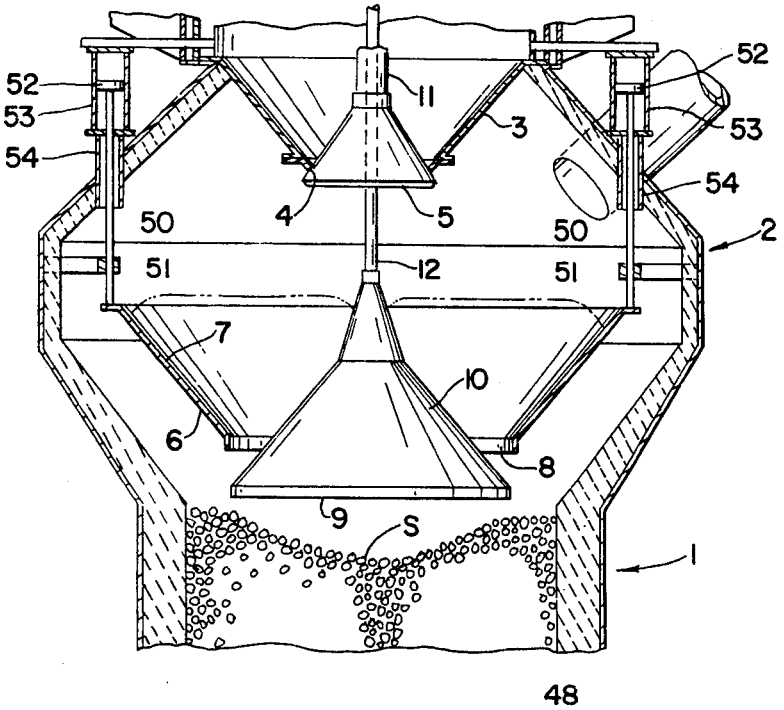
FIG. 5

CHARGING APPARATUS FOR SHAFT FURNACES

This is a division, of application Ser. No. 604,328 filed Aug. 13, 1975, which is a continuation of application Ser. No. 411,924, filed Nov. 1, 1973 now abandoned.

DISCLOSURE OF THE INVENTION

1. FIELD OF THE INVENTION

This invention relates to apparatus for charging material into a shaft furnace, and more particularly to apparatus for charging particulate charge or burden material into a shaft furnace such as a blast furnace to distribute the material in the furnace to provide a level or other desired shape of the top surface of the material in the furnace, and to prevent gas leakage from the furnace even if the furnace operates under severe conditions as occurs when the furnace has high internal gas pressure and is a large furnace of high productive capacity.

2. BACKGROUND OF THE INVENTION

While the invention may be used for other purposes, it provides particular advantages when used in blast furnaces, and therefore will be described as so used.

To achieve greater production and increased efficiencies and economies of blast furnace construction and operation, recent blast furnace designs have tended toward large furnaces of substantially higher internal top pressures of gas than have heretofore been common. In new furnaces being designed or built, top pressures range as high as 40 pounds per square inch gage (psig), hearth diameters range up to 50 feet or more, and diameters at the stockline vicinity range up to 30 feet or more, while iron productions range up to 10 thousand tons per day.

These factors of high gas pressure, large furnace size, and large productions have imposed severe problems in the design and operation of the charging apparatus for such furnaces to permit charging of the large quantities of charge materials in the desired distribution over the large internal cross sectional area of such furnace, to prevent during and between charging leakage from the furnace of the gas at such high pressures, and to prevent fluidization of the charge material within the furnace due to irregularities in the stockline that can cause localized channeling through the mass of charge material in the furnace and improper furnace operation.

2. DISCUSSION OF PRIOR ART

These factors cause great problems with the type of charging apparatus hertofore widely used having a hopper the bottom of which is closed by a large bell, and a rotatable hopper closed by a smaller bell and sealed at its circumference to prevent leakage of furnace gases. When charging material into the furnace, the small bell and the large bell are operated in known manner to prevent the loss of furnace gas pressure and thus act as gas lock means. Where higher gas pressures are used tendencies toward leakage are intensified at the rotatably sealed circumference of the rotatable bell hopper and at the engaging surfaces of the large bell and its hopper, particularly when in a large capacity furnace the diameters of the rotatable hopper and the large bell are made large enough to permit handling at a suitable rate of large amounts of burden material which must be charged into the furnace.

In the above or any other design of the furnace in which a large bell when closed is intended to act as a gas seal and is subjected to a difference in gas pressure, the furnace gas pressure being at higher pressure, the large bell is also subject to erosion by dust-laden furnace gas leaking past the juncture of the bell and its hopper, particularly at high top pressures.

Various proposals have been made to overcome these problems, mostly involving eliminating use of a rotatable bell hopper having a curcumferential gas seal. Some of these proposals have satisfactorily solved the problem of gas leakage out of the furnace at high pressures, but they have failed to solve the problem of eliminating bell erosion by furnace gas; or of providing a desired shape of the stockline within the furnace that will prevent fluidization of charge material within the furnace or other disadvantages arising from depressions or other irregularities in the stockline; or if they have solved this latter problem they have only done so by means of complicated, expensive and high maintenance cost equipment inside the furnace where they are exposed to heat, dust and abrasion, such as stockline armor or rotating chutes in the furnace.

SUMMARY OF THE INVENTION

It is an object of the invention to avoid the above and other problems and disadvantages of prior art apparatus.

It is a further object of the invention to provide apparatus for charging material into a shaft furnace such as a blast furnace that will operate efficiently in large or small furnaces to charge desired quantities of particulate charge material into the furnace in any of a wide range of desired distribution patterns circumferentially and radially across the furnace while the furnace is operating and gas pressure in the furnace is as high as any contemplated at present or in the foreseeable future.

The present invention provides apparatus for charging material into a shaft furnace, such as a blast furnace, including gas lock means for introducing charge material into the furnace while the furnace is under gas pressure, and, below the gas lock means, vertically adjustable distributor means that causes charge material to be deposited and distributed in the furnace either toward the outer periphery of the cross section in the furnace bounded by the interior of the furnace wall or toward the center of the cross section, or in both places, and circumferentially as desired, to provide a material stockline that is essentially level or of other desired shapes within substantial limits. The distributor means comprises a member such as a bell of generally circular horizontal cross section that has an upper surface that converges upwardly and inwardly toward its axis, and a cooperating surrounding distributor member such as a hopper, having a bottom opening through which the largest diameter portion of the movable distributor member may freely pass, the surrounding distributor member having an inner wall surface of generally circular cross section that diverges outwardly and upwardly from its lower opening, the outer surface of the movable member and the inner wall of the surrounding member cooperating to direct charge material either toward the outer periphery, or toward the center of the cross section within the furnace or toward any intermediate location, or toward a plurality of such locations by suitable positioning or movement of the movable distributor member relative to its surrounding distributor member to achieve and maintain in the furnace a stockline that is essentially level or of other desired shape within substantial limits.

The apparatus may also include means for sensing the level of the stockline at a plurality of locations around the outer periphery of the stockline and also at a central location, and means making possible utilization of information from the sensing means to control the charge distributing means to achieve the desired stockline shape. Such stockline level sensing means may take the form of known types of test rods or means for sensing gas conditions from such locations.

The furnace charging apparatus may have only one or at most only a few moving parts inside the furnace and hence can be substantially free of deterioration by heat or dust. There is no large bell that performs any gas sealing function, and hence there is no problem of erosion of such bell by leakage of dust-laden gas. The apparatus can be made to operate satisfactorily despite high furnace pressures and large volumes of charge material handled.

The apparatus of the invention may be made much simpler and less expensive than prior apparatuses to accomplish desired distribution of charge material within the furnace.

The stockline level sensing means makes possible accurate determination of the stockline level at several locations including a central location to enable the distributing means to be controlled to achieve and maintain a desired distribution of charge material in the furnace in accordance with the information from the stockline sensing apparatus.

Apparatus embodying the invention may be made if desired of sufficiently low overall height so that it can be installed in existing furnaces to replace existing charging equipment without major alterations to other top structure.

BRIEF DESCRIPTION OF THE DRAWINGS

These and other advantages of the invention will become apparent from the following description of several preferred embodiments in connection with the accompanying drawings:

FIG. 2 is a section along line 2—2 of FIG. 1 to a larger scale, showing the lower portion of the chute in broken lines;

FIG. 3 is a detail to an enlarged scale of the apparatus of FIG. 1 showning the initial position of the distributor bell with respect to its distributor hopper when the bell is to be moved downwardly to distribute charge material from the hopper;

FIG. 4 is a similar detail to the same scale as FIG. 3, showing the initial position of the distributor bell with respect to its hopper when the bell is to be moved upwardly to distribute charge material from the hopper;

FIG. 5 is a portion of the apparatus of FIG. 1 showing the stockline shape immediately after the distributor bell has been moved downwardly from the position shown in FIGS. 1 and 3, to distribute charge material from between the bell and its hopper;

DESCRIPTION OF PREFERRED EMBDOIMENTS

Figure 1:
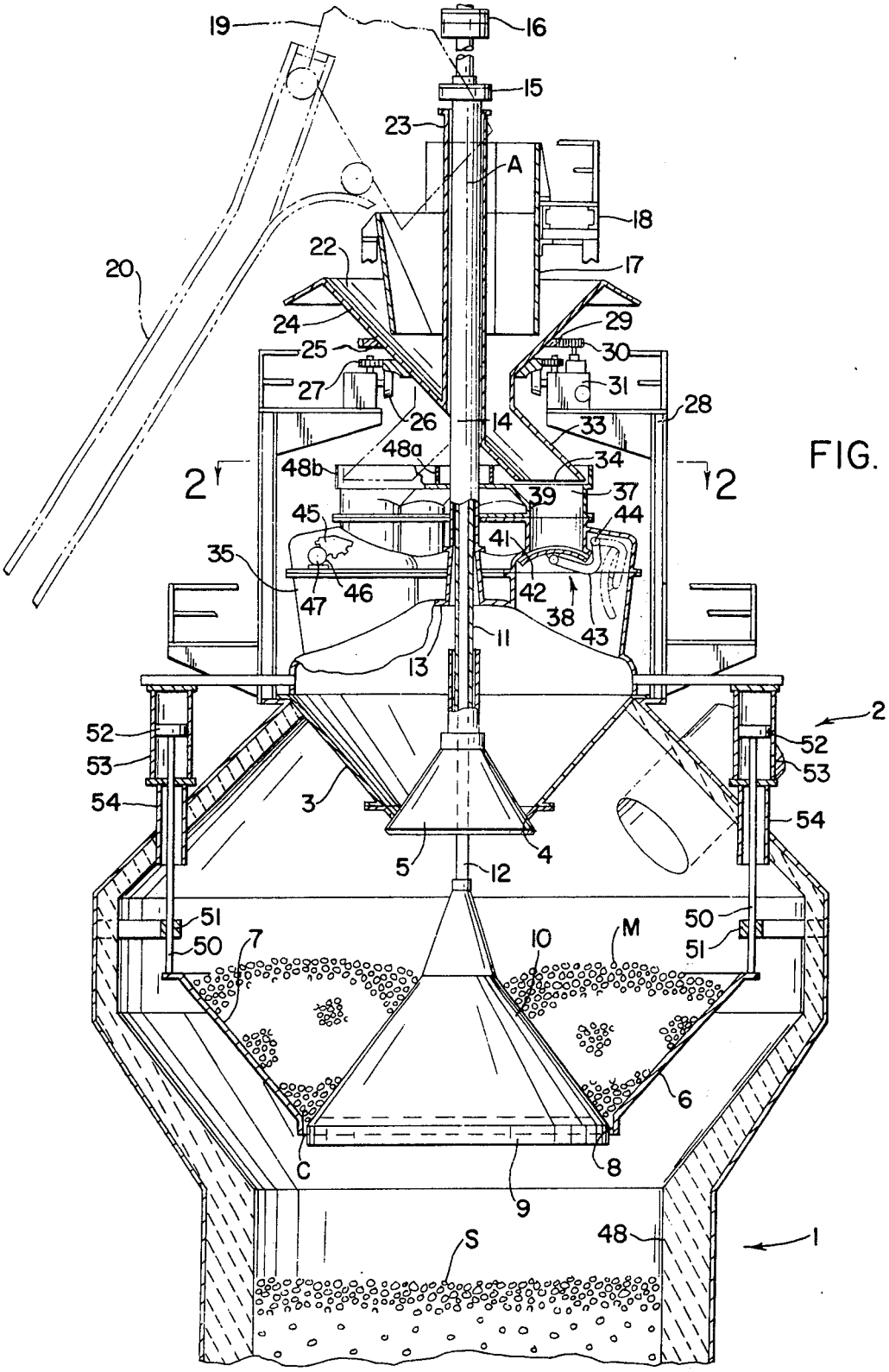
FIG. 1 is a vertical section through the upper portion of a blast furnace illustrating one preferred type of furnace charging apparatus embodying the invention, in which a distributor bell is movable to positions so the bottom of its frustoconical top may be below or above the bottom opening in a surrounding distributor hopper.

In the apparatus of FIGS. 1–17, a blast furnace 1 of otherwise known construction has an upper portion 2 comprising a stationary hopper 3 of circular cross section having a bottom opening 4 adapted to be closed and opened by a bell 5 that when closed holds charge material in the hopper and seals against escape of furnace gas that could cause loss of furnace gas pressure, and that when opened permits charge material to drop out of hopper 3. An annular distributor member 6 taking the form of a hopper having an upwardly and outwardly inclined inner surface 7 of generally circular cross section is concentrically located below hopper 3 and bell 5; hopper 6 has a bottom opening 8 through which a movable distributor member 9 taking the form of a bell with an upwardly inwardly converging, preferably sloping, top side 10 may pass in an upward path extending between a position in which the bell has the lower edge of surface 10 substantially below the bottom opening and a position in which the bell is inside the deflector member in which its lower edge is substantially above the bottom opening. The bells and hoppers are concentric about axis A of the furnace. The generally annular space or clearance C between the widest portion of the bell 9, at its bottom, and the opening 8 in hopper 6 is large enough to permit the bell to pass freely through the opening, but small enough to permit charge material to be held between the bell and hopper with little leakage of material when the bell is positioned with its bottom substantially aligned with opening 8 of the hopper, as shown in FIG. 1. This clearance depends on the size of the charge material particles, but in general about one inch or less is satisfactory in usual blast furnace practices.

Bell 5 is supported, lifted and lowered by bell rod 11. Distributor bell 9 is supported, lifted and lowered by bell rod 12 passing axially through bell rod 11. The bells may be nonrotatable, but if desired either or both may be rotated while free of its hopper to equalize wear. Known means, not shown, are provided for actuating the bell rods to raise and lower their bells as required, and for rotating the bells if desired.

Top wall 13 closing bell hopper 3 has a tubular portion 14 surrounding the bell rods and extending upward above the charging apparatus. Known seal 15 operates between portion 14 and reciprocable bell rod 11, and known seal 16 operates between bell rods 11 and 12, to prevent escape of furnace gases.

An upper fixed hopper 17 supported by frame 18 at the top of the furnace receives particulate charge material from a suitable supply source such as one or more conventional skip cars 19 traveling on tracks 20.

An open-topped chute 22 is rotatably mounted about axis A and has a tubular portion 23 surrounding portion 14 of bell hopper 3 and the bell rods and extending upward through hopper 17 to above the hopper to prevent undesired entrance of charge material. Chute 22 has an upper flared portion 24 into which hopper 17 extends.

Chute 22 is supported by and fixed to an annular member 25 that is rotatably supported and located by three or more tapered bottom rollers 26 rotatably mounted about horizontal axes and by three or more side rollers 27 rotatably mounted on vertical axes, on frame 28 keep the chute at all times centered about axis A. Chute 22 is rotated as required by a ring gear 29 on the chute meshing with a spur gear 30 driven by motor 32 energized by known means not shown.

Chute 22 has an inclined lower portion 33 communicating with upper portion 24 and having a lower end that is offset to a side of axis A and tubular portion 23 and that terminates in a discharge opening 34. A plurality, six in the illustrated embodiment, of port means 35 are disposed around axis A and fixed gas-tight to the top wall 13 of the furnace. Each port means comprises a housing portion 36 having an upwardly open mouth 37 the mouths all being of the same size and equidistant from and preferably equiangularly spaced around axis A. Each port means includes a gas sealing valve 38 mounted in housing 37 and adapted to close the lower end of passage 39 with its upper end terminating in the mouth 37. Each valve 38 comprises a stationary valve seat 41 and an upwardly convex movable closure member 42 pivotally mounted on an offset arm 43 fixed to a horizontal rotatable shaft 44 that extends outwardly of housing portion 35 but is sealed against gas leakage. Shaft 44 is turned as required by a gear segment 45 on the shaft and engaging gear 46 that is rotated as required by a motor 47. Other means for operating the valves may be provided. If desired, the mating surfaces of the valve seat and closure member may be surfaced with sealing material such as synthetic rubber.

The arrangement including offset shaped arm 43 is such that when the closure member of a port means is closed as shown full in FIG. 1 it closes passage 39 and hence the mouth of the port means and provides a gas tight seal even at high pressures in the furnace, the gas pressure on the closure member aiding in keeping the valve closed tight. When arm 43 is turned to the position shown in broken lines, all portions of the valve completely clear the passage and permit an uninterrupted and unimpeded flow of charge material from the chute through the port means into bell hopper 3.

Each valve 38 is operable independently of the other valves and the valves can be readily made so that when all valves are closed, there is no gas leakage even if the pressure in hopper 3 is high furnace pressure.

The mouth of each port means 35 and opening 34 at the lower end of chute 22 are so shaped that when the chute opening is aligned with a mouth, they facilitate unimpeded flow of material without appreciable spillage. Inner and outer upstanding side walls 48*a* 48*b* surrounding the port mouths and inclined walls 49*a* meeting at ridges 49*b* (FIG. 2) between adjacent mouths aid in preventing spillage.

FIGS. 5 to 11 inclusive illustrate different distribution patterns and stockline shapes that may be obtained by different positioning of bell 9. Assume the initial conditions are as shown in FIG. 1 and that charge material M has been deposited between hopper 6 and its bell 9 by means of chute 22, one or more gas valves 38, and bell 5 and hopper 3; and that bell 9 had been positioned as shown in FIGS. 1, 3 with the lower end of its sloped upper surface 10 a short distance above the lower end of the sloped inner surface 7 of hopper 6 to avoid jamming of the bell in the hopper opening 8 by particles of charge material between the bell and hopper. Distributor bell is then lowered and particles of the charge material shown in FIG. 5 in broken lines M passes through the space between opening 8 of hopper 6 and the sloped upper surface 10 of the bell 9 and is diverted outwardly and circumferentially toward the outer periphery of the interior space within the furnace 1 bounded by the interior of furnace wall 48 so that the shape of the stockline S is concave as shown in FIG. 5.

Figure 6:
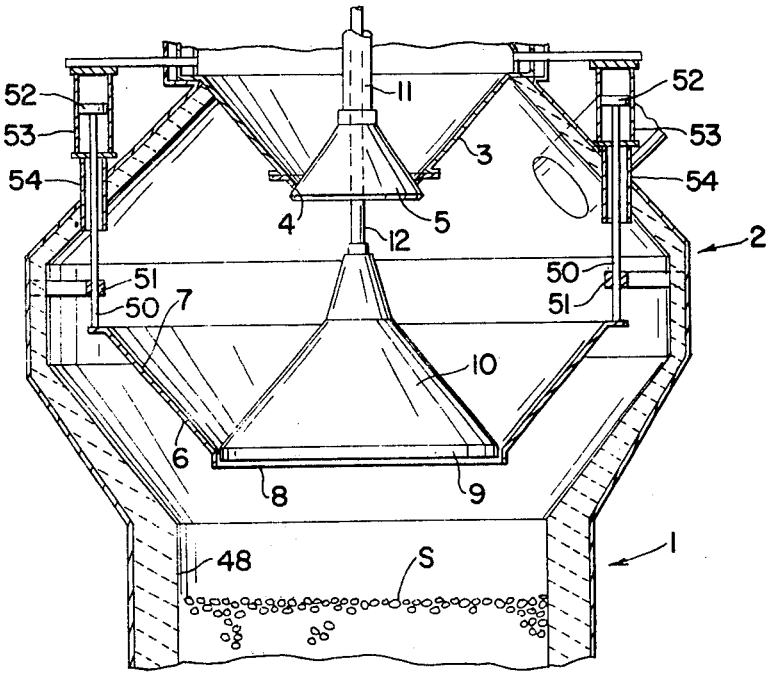
FIG. 6 shows a portion of the apparatus of FIG. 1, the distributor bell being in the position illustrated by FIG. 4 ready to receive charge material from the small bell hopper.
Figure 7:
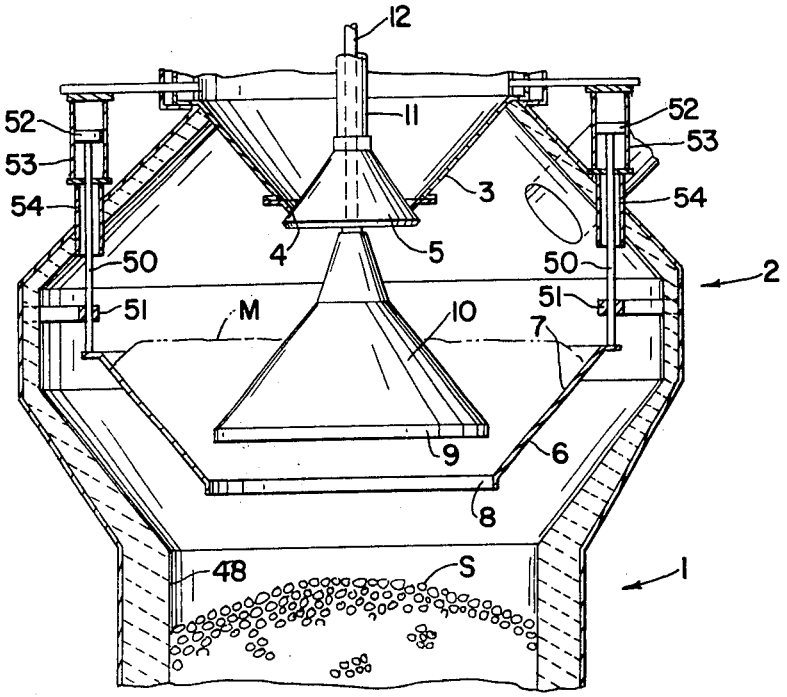
FIG. 7 illustrates the stockline shape after the distributor bell has been raised to the position indicated within its hopper to distribute charge material from between the bell and its hopper.

If it is desired to achieve a convex shape of the stockline, the bell 9 is first moved to the position shown in FIGS. 4 and 6 with the lower end of its sloped surface 10 a short distance above the lower end of the inclined inner hopper wall 7 to avoid jamming of the bell in the hopper by charge material. After charge material M has been deposited between the hopper and the bell as shown in FIGS. 1 and 7, the bell 9 is raised to the position shown in FIG. 7, causing the charge material to drop out of the hopper and be diverted by the downwardly sloping walls of hopper 6 inwardly toward the center of the furnace to form a stockline S with an upwardly convex circumferential shape as shown in FIG. 7.

Figure 8:
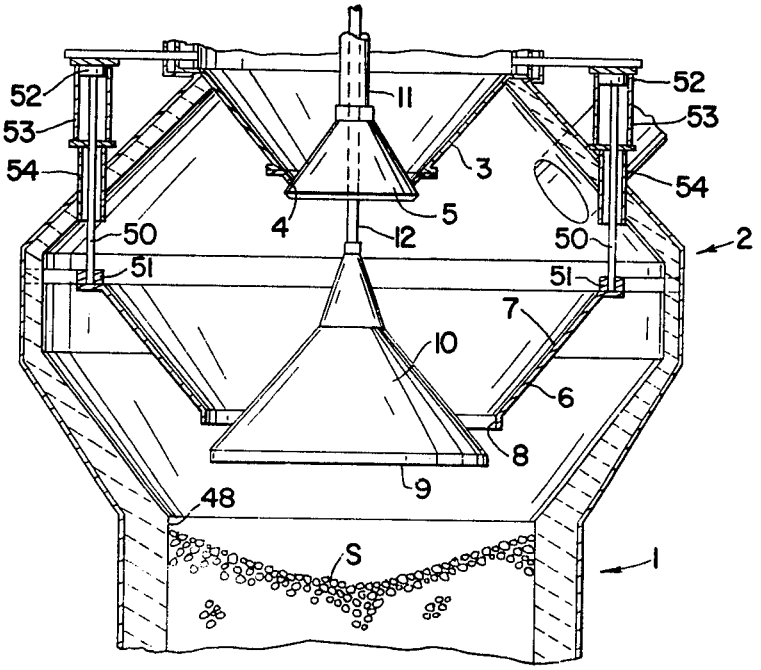
FIG. 8 is a portion of the apparatus of FIG. 1 illustrating how the distributor hopper can be adjusted upwardly to achieve a different distribution of charge material at the stockline.
Figure 9:
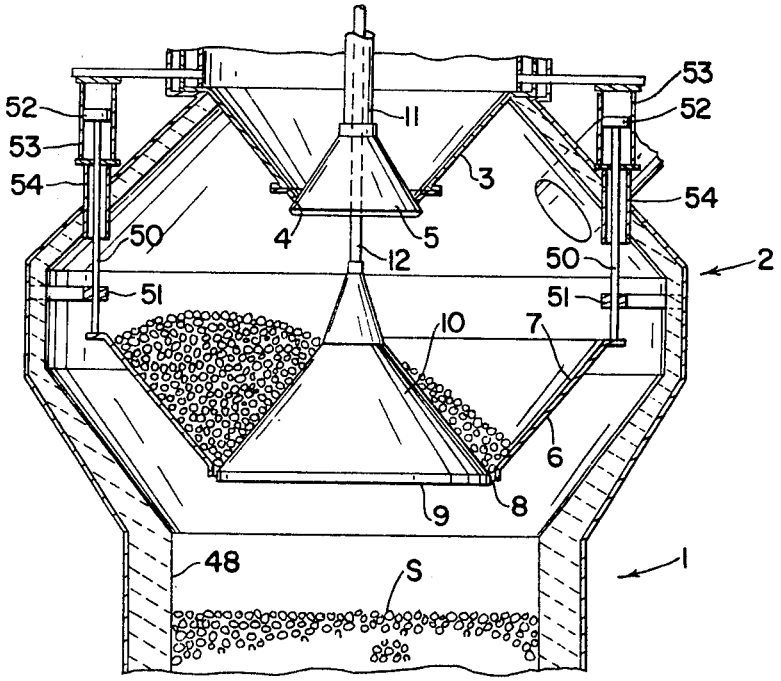
FIG. 9 is a portion of the apparatus of FIG. 1 showing charge material in the distributor hopper held in place by the distributor bell located as in FIG. 3, the charge material being off to one side of the hopper as occurs when it is fed in to one side.

While in the above described procedures the hopper 6 is stationary and in a fixed location in the furnace, FIG. 8 illustrates that, if desired, hopper 6 may be located in a higher location by piston rods 50 connected to the hopper and passing through guides 51 in the furnace and connected to pistons 52 in fluid operated cylinders 53 tubular gas shields 54 insuring against escape of furnace gas. Relocation of the hopper may be desirable under certain conditions, as if the stock line is high and it is desired to distribute more charge material toward the outer periphery of the furnace as shown in FIG. 8. Hopper 6 may be lowered by the cylinders 53 to achieve a result similar to that illustrated in FIG. 7 or to achieve the result illustrated in FIG. 5, if the stockline is low in either case.

Figure 10:
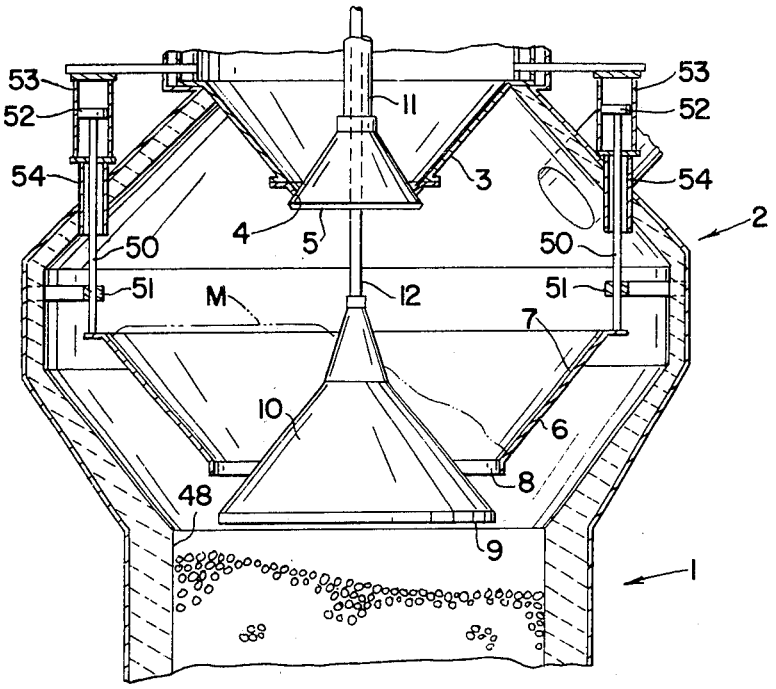
FIG. 10 shows the stockline profile after the large bell has been dropped when there has been an off-center loading of charge material in the distributor bell hopper as in FIG. 9.

FIG. 10 illustrates how it is possible to deposit more charge material in the furnace toward one side if desired, by first depositing more charge material to one side of bell 9 in hopper 6, so that when the bell is lowered the charge material M at such side will be diverted to form a raised portion of the stockline on the side of the furnace at which the greater amount of material was in hopper 6.

Figure 11:
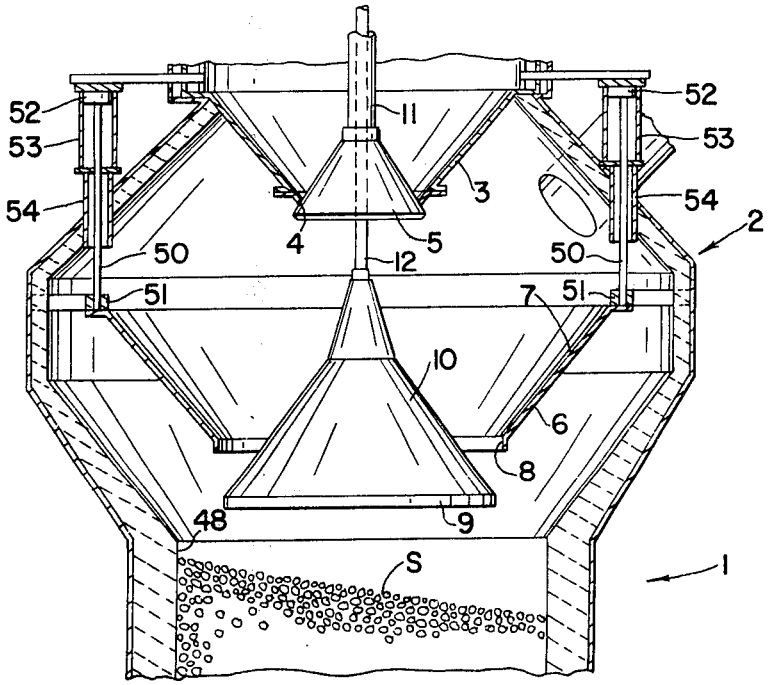
FIG. 11 shows the stockline shape that can result when there is a loading similar to that shown in FIG. 9 but the distributor hopper is raised before the lowering of the distributor bell.

FIG. 11 shows how a similar result can be achieved by raising the hopper and leaving the bell stationary.

By suitable raising or lowering of bell 9 relative to its hopper 6 in proper sequence or cycles, an essentially level stockline or any of a wide variety of other stockline shapes may be obtained.

Although it is preferable to do so by raising the bell, any of the stockline shapes of FIGS. 5–10, or others could be achieved by raising or lowering hopper 6 with respect to the bell, or by relative movements of both bell 9 and hopper 6.

Figure 12:
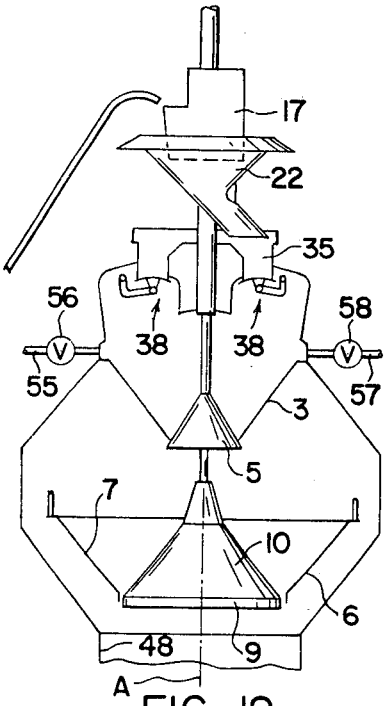
FIG. 12 through 17 diagrammatically show a desirable charging sequence of the apparatus of FIG. 1.
Figure 13:
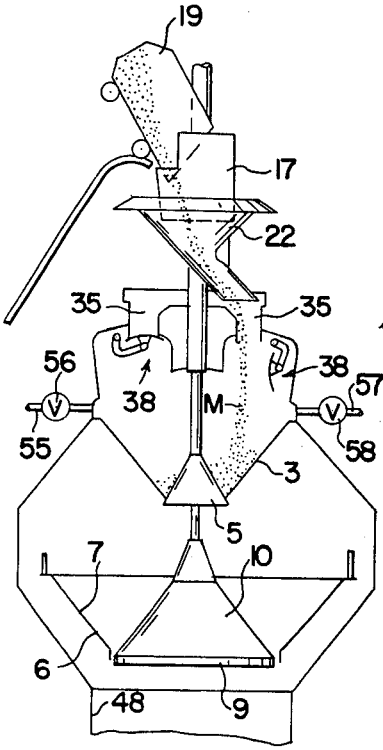
Figure 14:
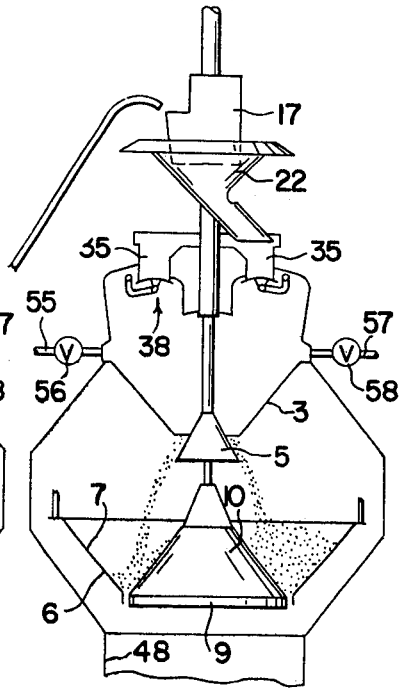
Figure 15:
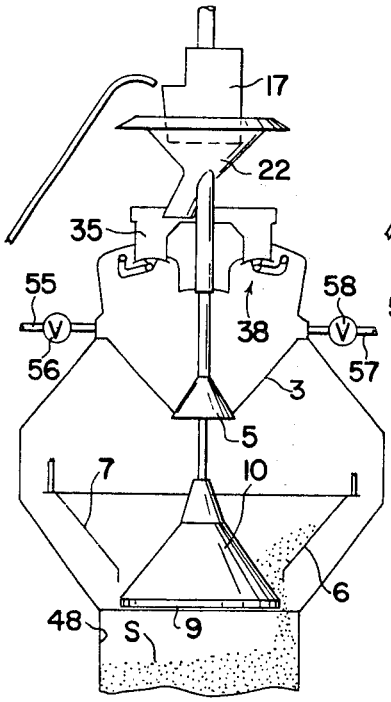
Figure 16:
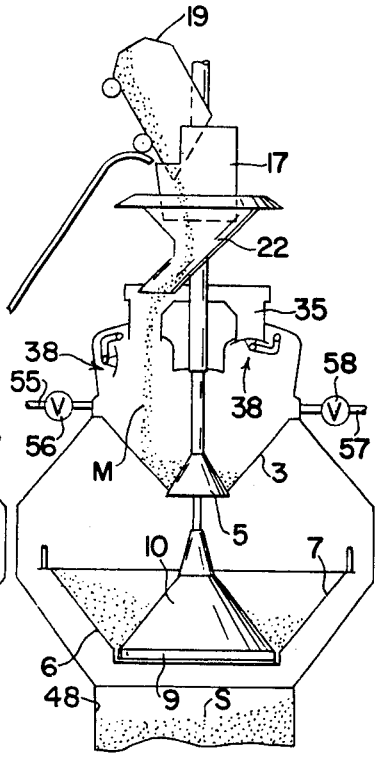

A preferred mode of operation of the charging apparatus of FIGS. 1–11 is illustrated by FIGS. 12–17. In FIG. 12, chute 22 while empty is turned to a selected one of the port means 35 and positioned stationary so its lower end is aligned with the mouth of such port means, all valves 38 and the bell 5 being closed. Distributor bell 9 is initially located as shown in FIGS. 3, 12 with the lower end of its sloped top surface 10 slightly below lower inclined inner surface of hopper 6 to avoid jamming by charge material. Preferably hopper 3 had been filled, as through pipe 55 and valve 56 with clean gas as steam, clean blast furnace gas, or nitrogen at a pressure approximately equal to or even slightly exceeding the gas pressure in the furnace. Bell 9 and its hopper 6 are exposed to gas at furnace pressure.

Thereafter, gas pressure in the hopper 3 is relieved through pipe 57 by opening valve 58. Then (FIG. 13), gas seal valve 38 of the selected port means 35 is opened and charge material from skip car 19 is discharged into hopper 17 from which it drops through chute 22 through the open port means into bell hopper 3 where it is retained by the closed bell 5.

Thereafter (FIG. 14) the open valve 38 is closed and bell hopper 3 is pressurized with clean gas through pipe 55 and valve 56. Bell 5 is then lowered to discharge material from hopper 3 into the space between hopper 6 and distributor bell 9. These steps may be carried out one or more times as required by the charging cycle; several skip car loads of charge material may be deposited in that space.

After the desired amount of charge material has been so deposited between hopper 6 and bell 9, and after the bell 5 has been raised to its upper closed position, the bell 9 is moved down (FIG. 15) to deposit charge material in the furnace to form an inclined stockline S.

Figure 17:
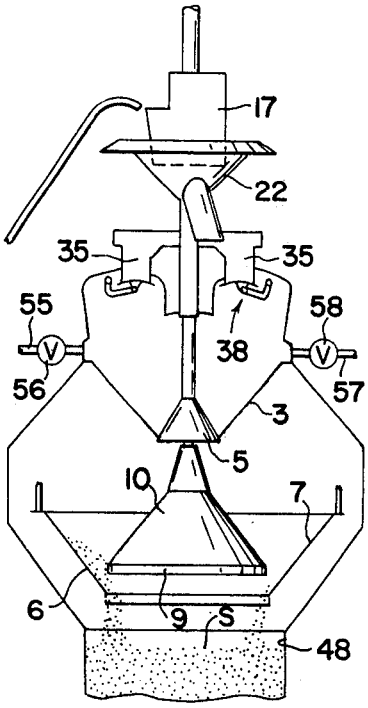

Thereafter (FIG. 16), chute 22 may be turned to another desired other port means 35 to achieve desired distribution of charge material into the furnace. In this case, the bell 9 is shown as having been previously positioned with the lower edge of its sloped surface above the lower edge of the sloped surface of hopper 6 (FIGS. 4, 16) since according to the illustrative program the bell is to be raised. With manipulation of gas valves 56 and 58 as described above, charge material is discharged from skip car 19 into the bell hopper 3 while the bell 5 closes the hopper and seals against escape of gas and the port means is open. The port means is closed after passage of charge material through the port means is stopped, after which bell 5 is lowered to deposit material in hopper 6 and on bell 9 as previously described. After the proper amount of charge material is so deposited by one or more operations of the port means valve 38 and the bell 5, the bell 9 (FIG. 17) is then raised to a position inside of its hopper 6 so that the material in that hopper drops and is deflected by the action of this bell and its hopper so that charge material is deposited at a desired position on the previously deposited material and therefore achieves a desired stock line shape. As shown in FIG. 17 by proper selection of the port means into which charge material is to be deposited and by proper sequencing of the directions of the movements of bell 9 after it has been loaded with charged material, a substantially level stockline is obtained, although any other suitable stockline shape within wide limits may be obtained.

The above or other cycles of operation may be used during the furnace campaign to use all port means in a sequence designed to achieve the desired distribution of a desired charge material in the furnace to achieve the desired stockline shape. Of course other modes of operation of the above described apparatus and suitable modifications of the above described processes are possible, including those in which the chute is rotated after each skip car load is deposited in the furnace, or those in which more than one skip car load of material is deposited in hopper 6 before bell 5 is lowered.

Figure 18:
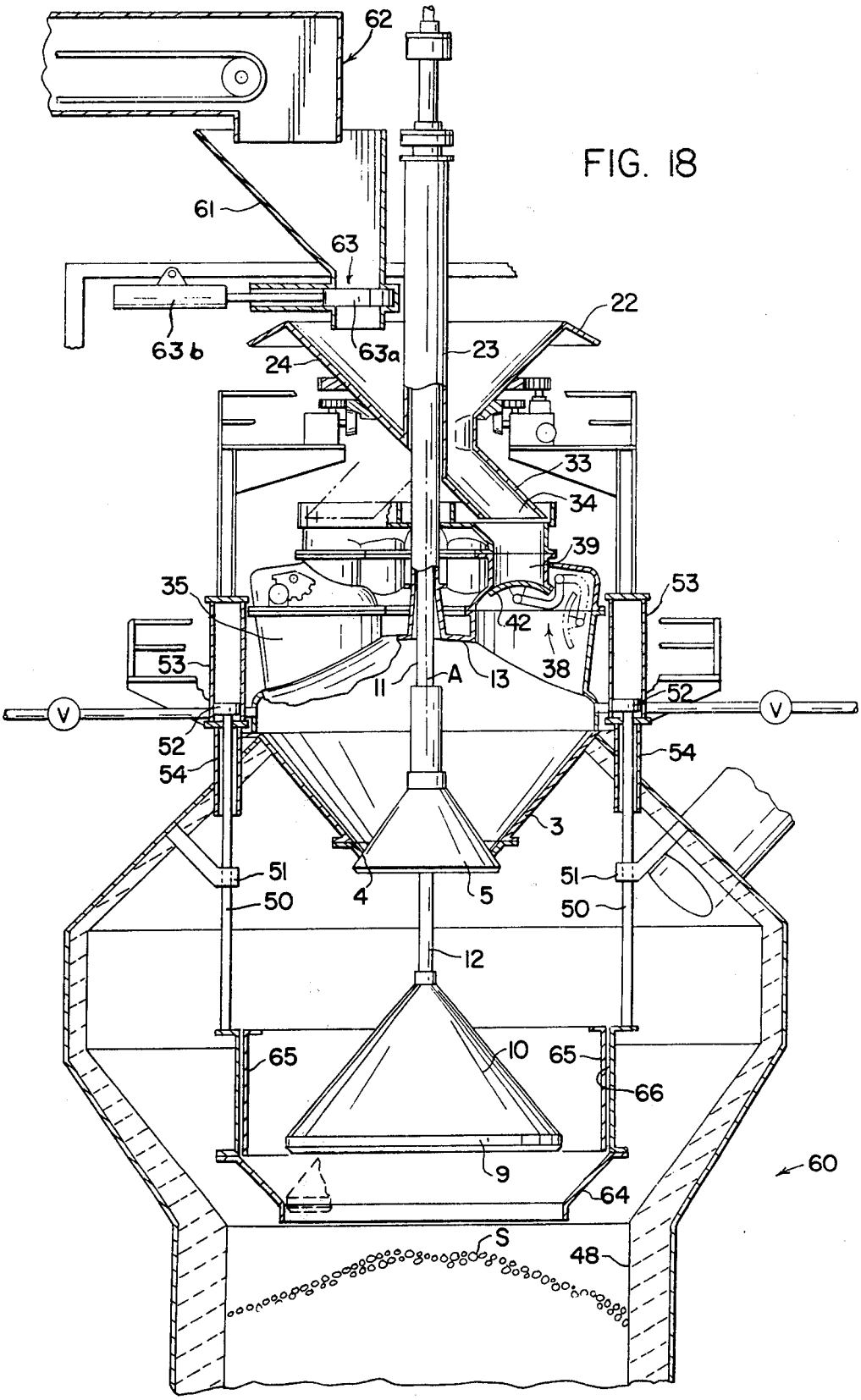
FIG. 18 shows a modification of the apparatus of FIG. 1 in which, among other features, charge material is supplied to the apparatus by a conveyor and in which the distributor bell hopper has a liner movable relative to the hopper to reduce possibilites of jamming or sticking of charge material in the hopper.

FIG. 18 illustrates another blast furnace 60 embodying the invention in which parts corresponding to the preceding embodiment have the same reference characters, and in which charge material is deposited in an upper hopper 61 by a known belt conveyor assembly 62, supplied and driven by known means not shown. Hopper 61 is located at one side of portion 23 of chute 22, and since conveyor 62 brings charge material substantially continuously to hopper 61, has a material cut-off valve 63 to prevent material from dropping into the chute at all times while the chute is not aligned with an open selected port means. Valve 63 has a closure member 63*a* movable horizontally between open and closed positions by a fluid-actuated cylinder 63*b* mounted on the frame of the blast furnace and controlled as required by known means not shown to feed material through the chute into an open port means.

Another mode of operation is possible in which conveyor 62 deposits charge material to hopper 61 discontinuously in slugs so timed that charge material is discharged from the conveyor only the port means with which the chute is aligned is open. In such case valve 63 may be eliminated or left open, and operation is apparent from the description of FIGS. 1–17.

In the apparatus of FIG. 18 the distributor hopper 64 that can cooperate with distributor bell 9 as previously described, has a liner 65 that is movable, upwardly or downwardly or otherwise, relative to the hopper. This liner is shown as preferably cylindrical and slidably located adjacent a preferably cylindrical wall 66 of the large bell hopper. This liner prevents or reduces the possibilities of sticking or jamming of charge material in hopper 64.

FIGS. 19–24 illustrate construction and operation of another blast furnace embodying the invention in which charge material is discharged from an upper location disclosed as a bell hopper, onto and into a distributor member such as a bell and a surrounding distributor hopper, while the bell is being moved upwardly or downwardly with respect to the hopper to achieve desired distribution of charge material in the furnace.

Blast furnace 67 of otherwise known construction, has an upper portion 68 comprising a lower stationary distributor hopper 69 having a bottom opening 70 through which a distributor bell 71 can move in an upright path extending between a bell position below the hopper (FIGS. 21, 24) and a bell position above the hopper (FIGS. 22, 23) and can move from either of these positions to the other. Above hopper 69 is another stationary hopper 72 having a bottom opening 73 that opens into the top of hopper 69 and is adapted to be opened and closed by a smaller bell 74, the bells being symmetrical about axis A of the furnace. Bell 71 is supported, lifted and lowered as required by a bell rod 75, and bell 74 is supported, lifted and lowered in a tubular bell rod 76 surrounding rod 75, both bell rods being supported and operated by known means not shown. In the previous embodiment, neither of these bells need rotate, but either or both may be rotated by known means when free of its hopper to equalize wear.

Furnace top wall 77 closing the top of hopper 72 has tubular portion 78 surrounding the bell rods and extends up to above the charging apparatus. Known sealing means prevent escape of furnace gas past this portion and the bell rods.

A plurality, preferably at least four, port means 79 are disposed around axis A of the furnace on wall 77 of the furnace. As in the previous embodiments, each port means comprises a housing 80 fixed gas-tight on wall 77 and having an upwardly open mouth 81 the mouths all being preferably the same size and equidistantly and preferably equiangularly spaced around axis A. Each port means includes a gas sealing valve 82 in housing 79 adapted to close the lower end of passage 83 the upper end of which terminates in mouth 81. Each valve comprises a stationary valve seat and an upwardly convex movable closure member 84 pivotally supported by a horizontal operating shaft 85 that extends to the outside of the housing and may be operated by suitable means. When the valve of a port means is closed it provides a gas tight seal even at high pressures in the furnace; and when the valve is open as shown in broken lines in FIG. 19 all portions of the valve permit uninterrupted and unimpeded flow of charge material into hopper 72. Each valve is operable independently.

Mounted above the furnace for rotation about axis A is an open-topped chute 86 having a central tubular portion 87 surrounding tubular portion 78, and also has an outer wall the upper portion 88 of which is preferably of circular cross section that extends around and is spaced from portion 87, and a lower portion 89 that is inclined and terminates in a discharge opening 90 that is adapted to be moved over and aligned with the mouth of each port means by rotation of the chute. Opening 90 of the chute is adapted to be opened and closed by a material holding gate 91 pivotally mounted at the lower end of the chute and opened and closed as required by a lever 92 and reciprocable rod 93 actuated by a motor 94 on the chute. Shield 95 protects the gate from external obstructions and also aids in preventing escape of charge material from the chute; it has generally lateral portion 96 adapted to fit within a channel shaped portion 97 that extends around the mouths of the chutes and thus prevents escape of charge material as it passes from the chute into the port means.

The chute is supported for rotation by an annular member 97 fixed to the chute and supported by at least three bottom rollers 98 and side rollers 99. The chute is rotated by a gear 100 engaging a ring gear 101 on member 97 and driven by suitable means 102. Charge material is supplied to the chute by a conventional belt conveyor assembly 103. If charge material is continuously supplied to the chute, it is discharged when desired into a selected open port means by opening the gate 91 and thereafter closing it.

Figure 20:
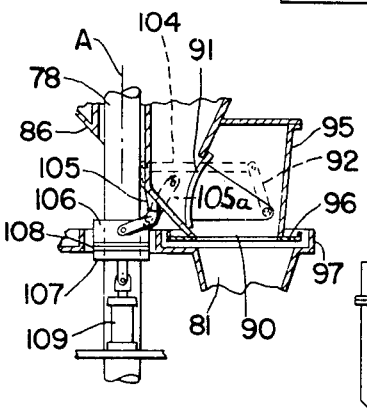
FIG. 20 is a detail illustrating a modification of FIG. 19.

FIG. 20 illustrates a modification in which chute gate 91 is actuated by power means not mounted on the chute. Operating lever 92 of gate 91 on chute 86 in connected by a rod 104 to one arm of bell crank lever 105 mounted on the chute through a pivoted link 105*a*. The other arm of lever 105 is pivotally mounted on a collar 106 rotatably and slidably mounted on tubular portion 78 of the furnace. Another collar 107 is slidably and non-rotatably mounted in portion 78 and connected by a rotatable joint 108 to collar 106 to move it on portion 76. Collar 107 is moved up and down as required to operate gate 91 by fluid cylinders 109 nonrotatably mounted on opposite sides of portion 78. Preferably two levers 92, bell cranks 105, links 105a and rods 104 are mounted on opposite sides of the gate and collars.

Figure 19:
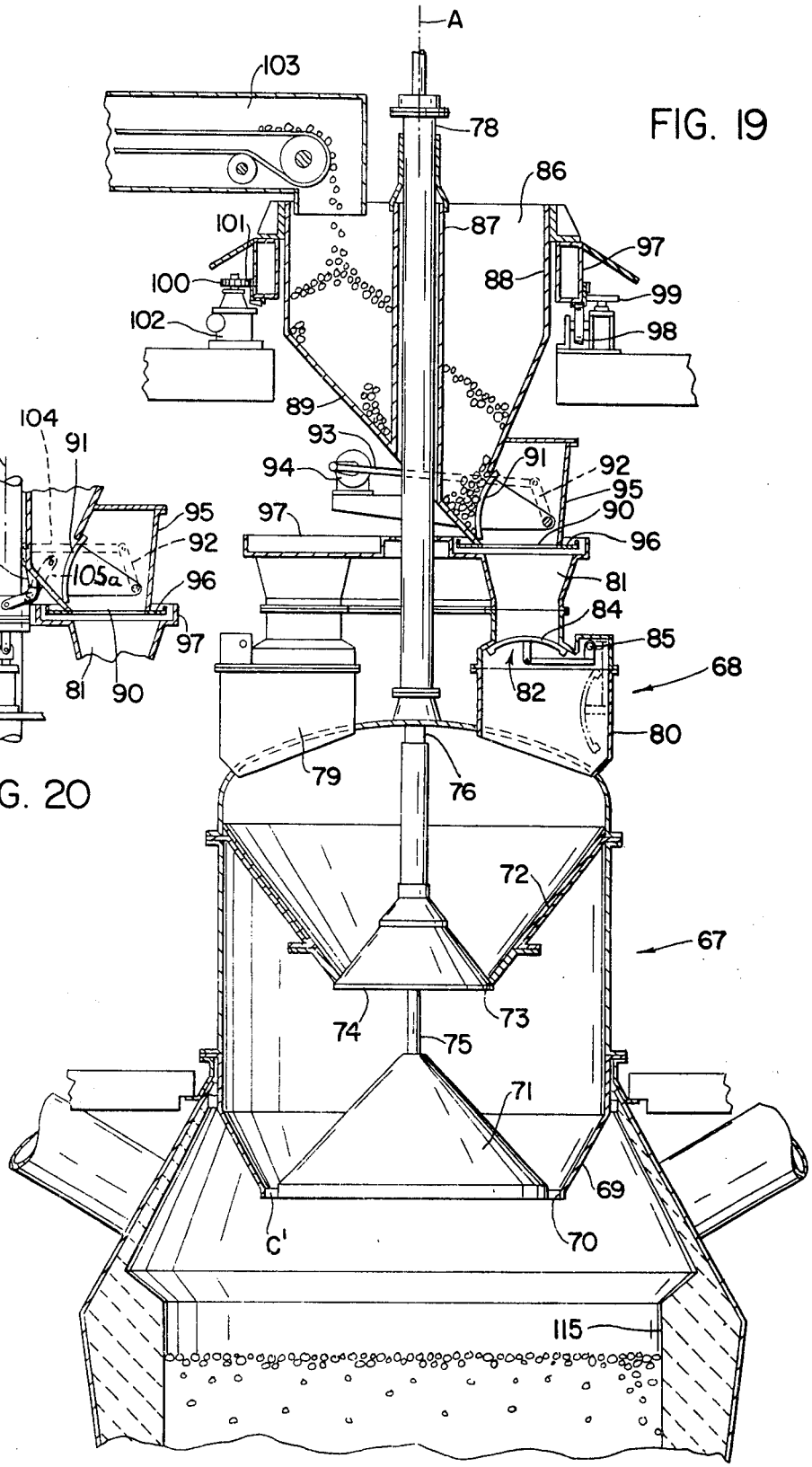
FIG. 19 illustrates another preferred embodiment of the invention operable so that charge material is discharged from an upper small bell hopper into the distributor bell hopper and onto the distributor bell and into the furnace while the bell is moving.
Figure 21:
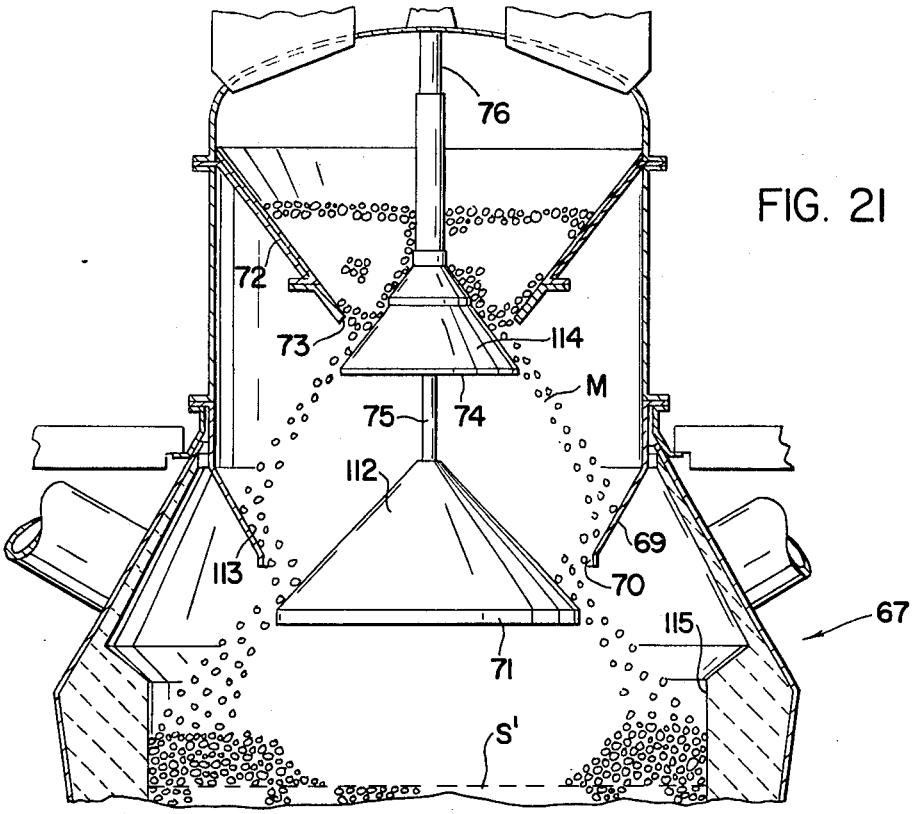
FIG. 21 illustrates a mode of operation of the apparatus of FIG. 19 in which material from the small bell hopper is discharged into the distributor hopper and onto the distributor bell while such bell is moving upwardly from an initial lower position.
Figure 22:
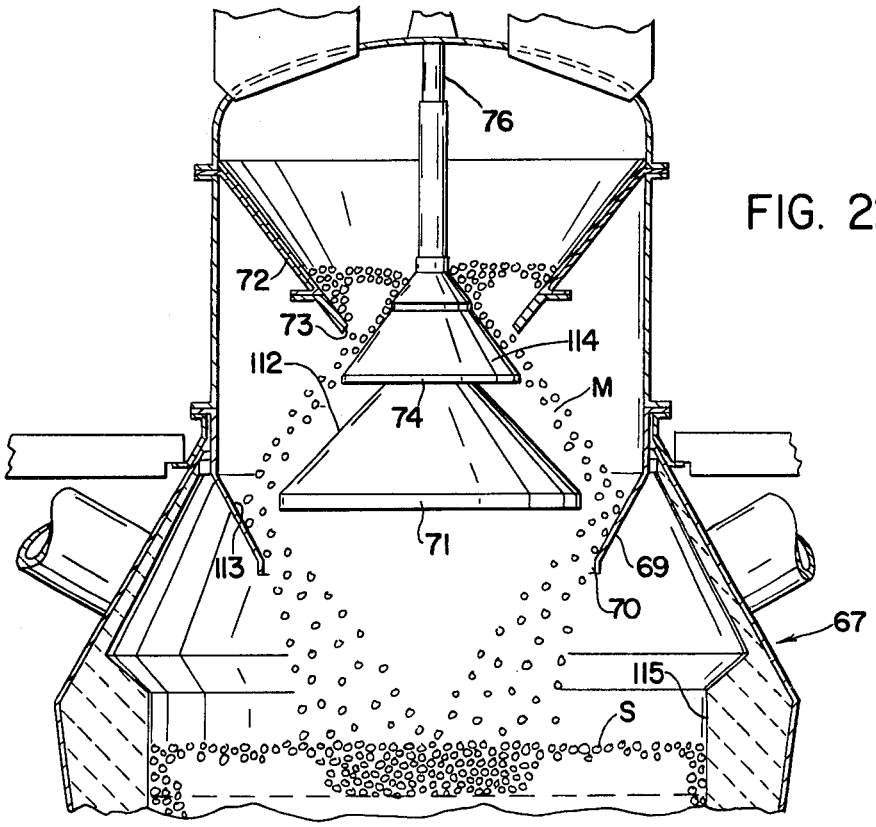
FIG. 22 illustrates a continuation of the operation begun in FIG. 21 as the distributor bell moves its upper position in the distributor hopper.

One preferred method of operation of this embodiment is illustrated by FIGS. 19, 21 and 22. In this method the desired amount of charge material is deposited in the upper hopper 72 while it is closed by bell 74, which can be done by introducing proper amounts of charge material into selected ones of open port means by operation of chute gate 91, closed bell 74 acting to hold material in the hopper and to hold the gas pressure in the furnace at this time. Before or during placing of the charge material in bell hopper 72 distributor bell 71 is lowered so the lower edge of its upwardly inwardly convergent preferably frustoconical surface 112 is at a predetermined position below opening 70 at the bottom of the downwardly inwardly convergent inner wall 113 of the distributor hopper 69. Thereafter, bell 74 is lowered, causing the particles of charge material M to discharge from hopper 72, being deflected outwardly as shown in FIG. 21 by the sloping top surface 114 of bell 74 so the particles contact the inclined surface 113 of distributor hopper 69 and are deflected inwardly to contact the sloped surface 112 of the bell 71 and then are deflected outwardly toward the outer periphery of the space in the furnace bounded by furnace wall 115. If the prior stockline was level as shown by broken lines S' in FIG. 21, the discharged material will temporarily form a concave stockline as shown in FIG. 21. Distributor bell 71 is moved up from the position of FIG. 21 to that of FIG. 22 while discharge of charge material continues from hopper 72. As bell 71 moves upwardly, the influence of surface 112 in locating the charge material in the furnace decreases and the influence of the inclined surface 113 of hopper 69 predominates and the particles of charge material are deflected inwardly toward the center of the stockline as shown in FIG. 22.

Figure 23:
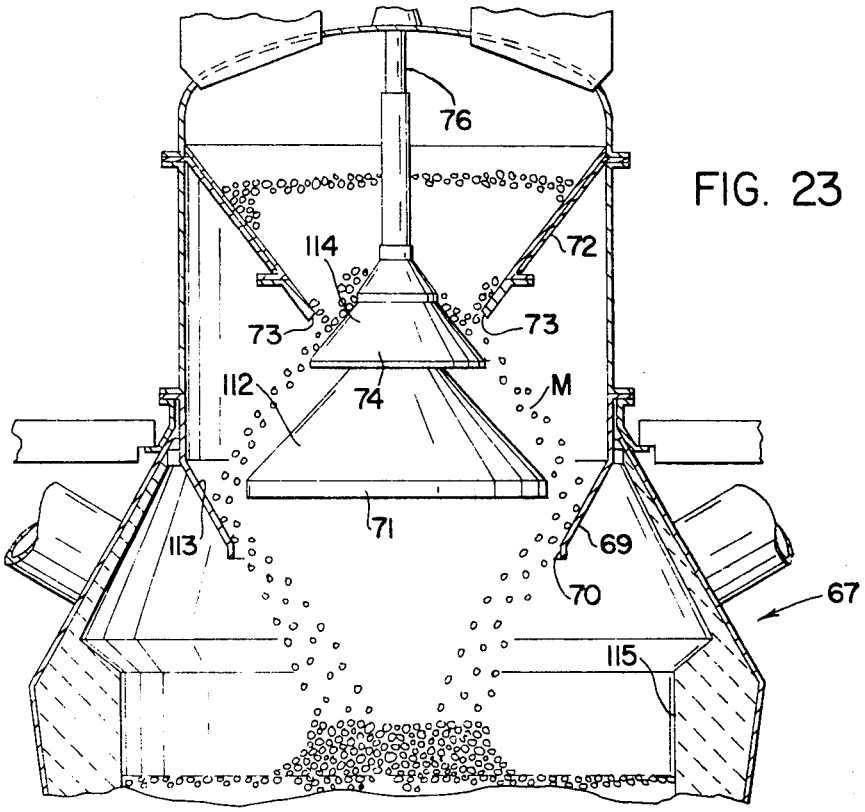
FIG. 23 illustrates another mode of operation of the apparatus of FIG. 19 in which material from the small bell hopper is discharged while the distributor bell is moved downward from an initial raised position within the distributor bell hopper.
Figure 24:
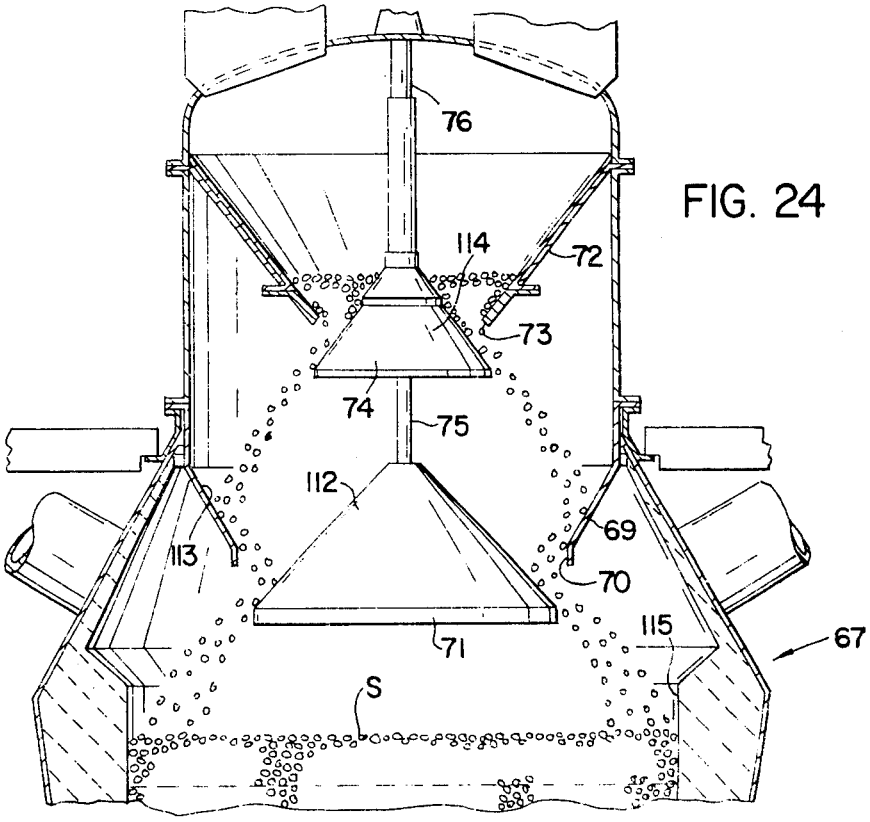
FIG. 24 illustrates a continuation of the operation illustrated in FIG. 23 as the distributor bell reaches its lower position.

FIGS. 23 and 24 illustrate an alternative mode of operation in which as shown in FIG. 23 bell hopper 72 has had a suitable amount of charge material deposited in it by a procedure as described above, and the distributor bell 71 is initially in raised position within its hopper 69 with the lower edge of its sloped surface a substantial distance above the bottom edge of hopper opening 70. When the bell 74 is lowered as shown in FIG. 22, particles of charge material M are initially deflected to strike the inwardly inclined inner surface 113 of distributor hopper 69 and be deflected by them inwardly towards the center of the furnace stockline, as shown in FIG. 23. Bell 71 is moved downwardly as material is discharged from hopper 72. As the bell is lowered to the position shown in FIG. 24, the paths of the material particles change as they are gradually deflected outwardly toward the outer edge of the stockline.

The generally annular clearance C' between the widest portion of distributor bell 71 and hopper opening 70 is substantially greater than in the previous embodiment to permit particles of charge material to pass freely, without jamming, as the wide portion of the bell moves upwardly or downwardly through the opening as charge material is discharged from hopper 72. The relationship of the diameters and inclination of top surface 112 of bell 71 and the inclined surface 113 of hopper 69, and the relationship of diameter and inclination of the top sloping surface 114 of bell 74, as well as the distance between the bells, are selected so that the above described actions occur.

By proper control of the movement of the distributor bell 71 with respect to its hopper 72, any desired stockline configuration within substantially wide limits can be achieved, even a substantially level stockline as shown in FIGS. 22 and 24. To achieve this, the bell may be moved at a uniform speed which is often preferable, or at a changing speed, between the ends of its path movement; or it may be caused either to dwell, speed up, or slow down for a short time at the beginning end or the finish end or at both ends, or at one or more suitable positions intermediate, of its path of movement.

FIGS. 25–28 illustrate another embodiment of the invention and a different mode of operation. In this embodiment, parts identical with those of the embodiment of FIG. 19 have the same reference characters. The apparatus of FIGS. 25–28 has a distributor hopper 117 having an inner surface 118 and a distributor bell 119 having an outer surface 120 different from those of previously disclosed corresponding parts. The surface 118 of the wall of the hopper extends downwardly and inwardly to the lower edge of hopper opening 122 in this embodiment. The outer surface 120 of distributor bell 119 comprises an upper portion 123 that converges upwardly and inwardly and is preferably frusto-conical, and a lower generally upright skirt portion 124 of substantial depth that is preferably cylindrical.

Charge material supplied by conveyor assembly 162 through rotatable chute 86 and its gate 91 and through selected port means 79 is accumulated in hopper 72 from which it is discharged when desired by lowering its bell 74. The parts and proportions of the bells and their hoppers, and the shapes of bell 119 and the inner wall 118 of hopper 17 are, as shown in FIG. 25–28, such as to achieve a substantially level stockline as illustrated in FIGS. 25, 26, or a stockline that has an upwardly convex shape as shown in FIG. 27, or stockline that has a concave shape as shown in FIG. 28, or modifications of these, by discharging material from hopper 72 into hopper 117 while distributor bell 119 is stationary but positioned differently in each case relative to its hopper.

Figure 25:
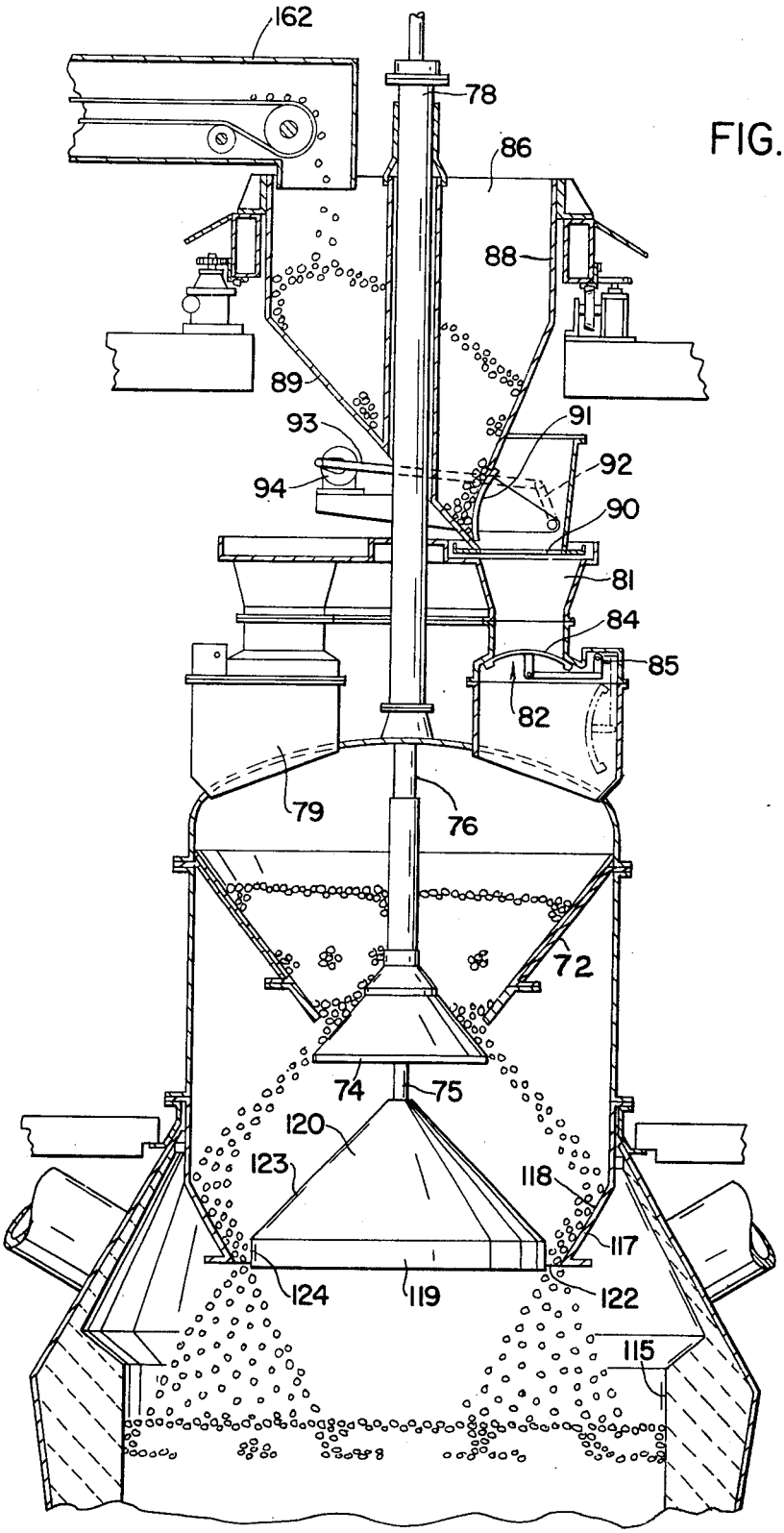
FIG. 25 shows another embodiment of the invention in which a distributor member is held stationary with its lower end within the opening of a hopper with a sloping wall, as charge material is discharged into the hopper, to achieve desired distribution.
Figure 26:
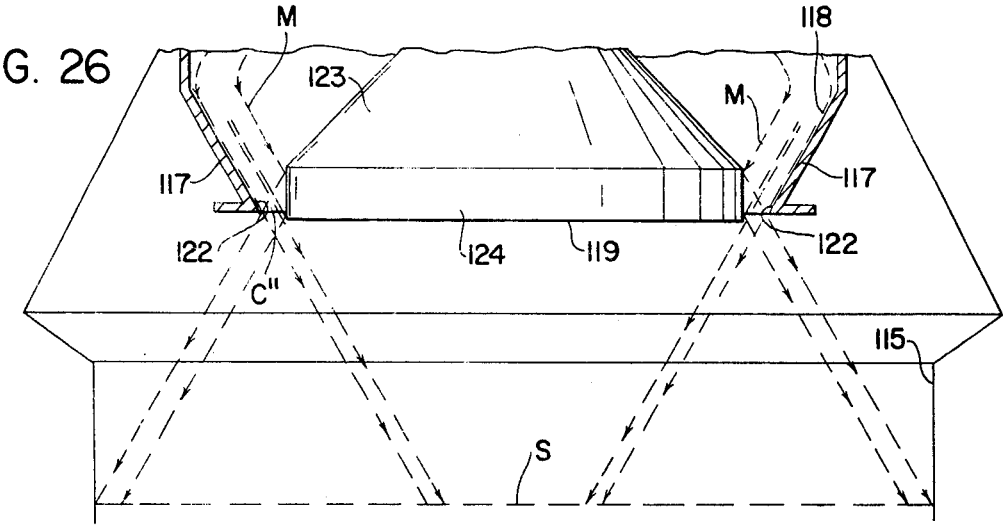
FIG. 26–28 illustrate various modes of operation of the apparatus of FIG. 25.

Referring first to FIGS. 25 and 26, distributor bell 119 is positioned so a major portion of its skirt portion 124 is above the lower edge of the hopper opening 122 at which terminates the inclined inner surface 118 of hopper 117, while a small portion of the skirt portion is below this lower hopper edge. The diameter of the skirt portion 124 of bell 119 is sufficiently smaller than the diameter of opening 122 so that a substantial generally annular space C" extends between the bell skirt and the opening. Particles of charge material discharged from upper hopper 72 on lowering of bell 119 will be moved outwardly by the sloped top surface of bell 119 to drop onto and move downward essentially parallel to the inclined surface 118 of hopper 117 and then are diverted so that part of them are deflected toward the center of the furnace under the bell and a portion strike the skirt portion and are deflected toward the outer periphery of the furnace, as shown in broken lines in FIG. 26. Actual tests have shown that a substantially level stockline can be achieved while the distributor bell is stationary, depending on the position of the bell with reference to its hopper.

Figure 27:
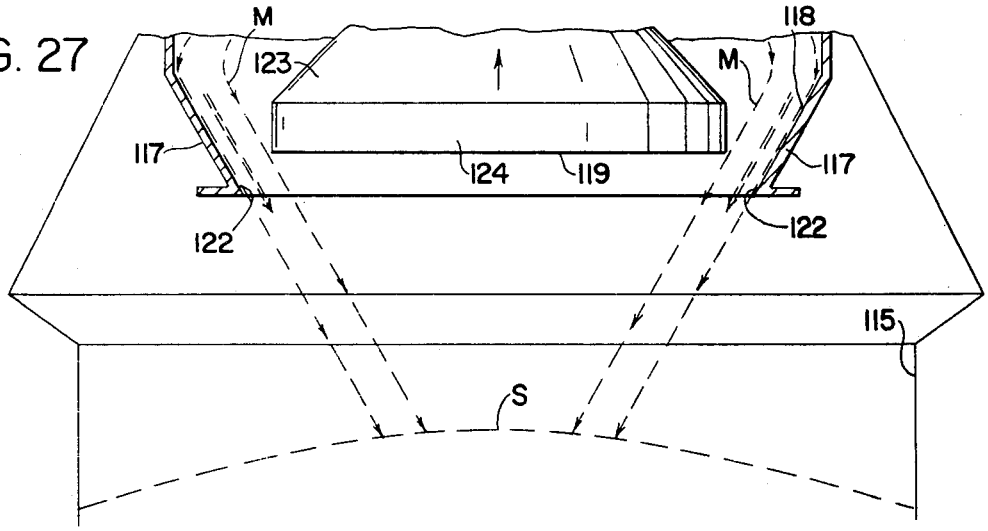
Figure 28:
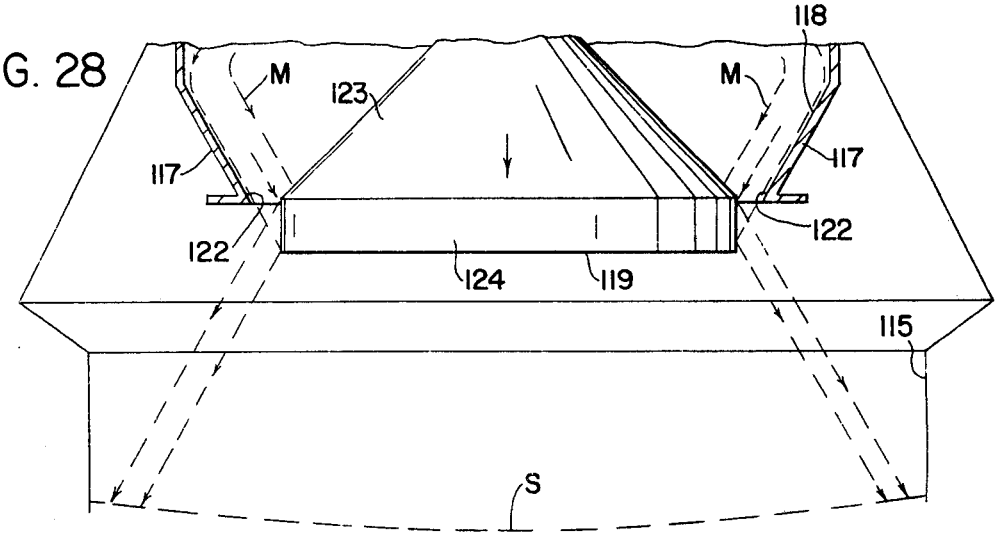

If the bell 119 is raised so its skirt portion does not interfere with charge material moving downward along inclined wall 118 of hopper 117, then substantially all particles of charge material are directed toward the center of the furnace and a concave stockline develops as shown in FIG. 27. If distributor bell 119 is lowered so that substantially all charge material that is deflected by the downwardly inclined surface 118 of the hopper strikes the cylindrical skirt portion 124 of the bell and if desired a portion of the upwardly sloped surface of distributor bell 119, the material is substantially all deflected outwardly toward the periphery bounded by furnace wall 115 so that a substantially concave stockline develops as shown in FIG. 28.

By suitable positioning of the bell with respect to its hopper, therefore, a wide variety of stocklines can be achieved, while the bell is stationary. It is also possible to achieve stockline modifications by moving the bell slowly, as between the ranges shown in FIGS. 26–26, to achieve variations in the stockline.

The generally annular clearance C between the skirt portion 124 of the distributor bell 119 and the hopper opening 122 is substantial, and usually wider than is required in the previously described embodiments. The diameter of the distributor bell, the diameter of the hopper opening, the inclinations of the converging and diverging surfaces of the distributor bell and distributor hopper, are selected to provide the results described above in connection with FIGS. 25–28. The space "C" should be wide enough to permit free passage of particles of charge material between the bell and its hopper, but narrow enough to permit charge material to be deflected as required by the skirt portion.

Figure 29:
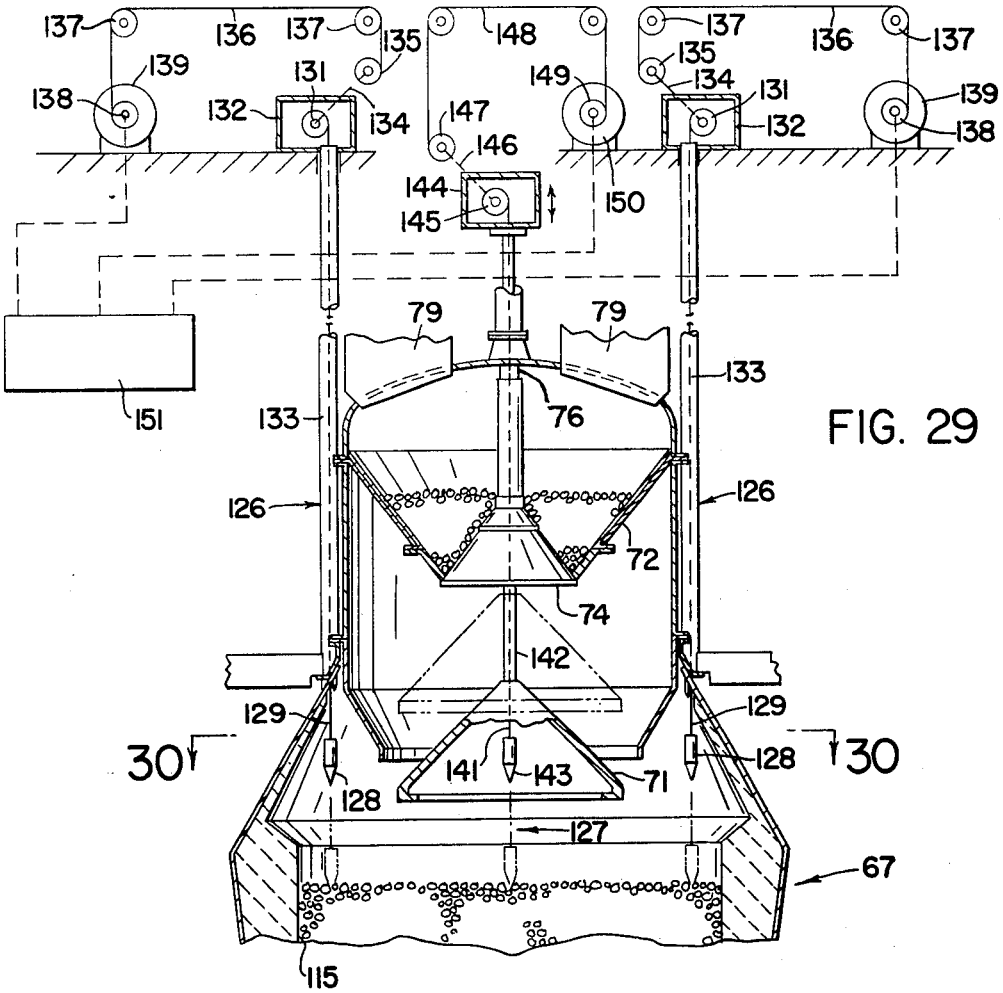
FIG. 29 illustrates stockline level measuring means embodying the invention, as applied to the apparatus illustrated in FIG. 19 although it can be applied to apparatus illustrated in the preceding figures.
Figure 30:
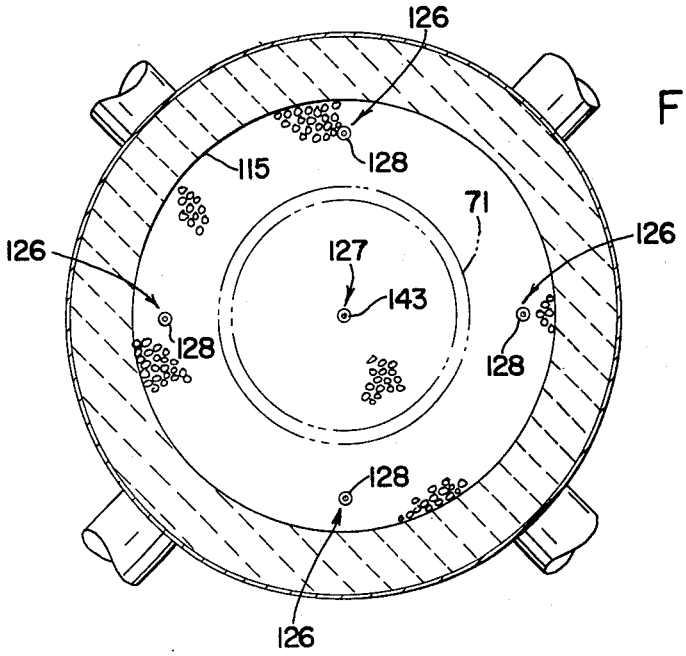
FIG. 30 is a section along line 30—30 of FIG. 29 showing the location of stockline level sensing elements.

To aid in controlling position or movement of the distributor bell in any of the above embodiments to achieve a desired stockline shape, stockline level sensing means such as illustrated in FIGS. 29 and 30 may be used. For illustration this means is shown as used in furnace 67 of FIG. 19, and parts shown are identical with those of FIG. 19 with the following additions. The apparatus of FIGS. 29 and 30 includes a plurality, four in the indicated embodiment, of outer stockline level sensing devices 126 equidistantly and equiangularly spaced to check the levels of the stockline near the outer periphery of the stockline in the furnace. There is also another stockline level sensing device 127 located substantially coaxially of the furnace to check the level of the stockline centrally of the furnace. More specifically, each stockline sensing means 126 may be a known device, often referred to as a "stockline test rod," comprising a sensing member 128 of substantial weight and preferably having a conical lower point, which member is supported by a steel cable 129 adapted to be wound on and unwound from a winch drum 131 mounted in a gas tight housing 132 that communicates with the interior of the furnace 67 through vertical tube 133. Therefore, member 128, it cable 129, and its winch drum 131 are at all times exposed to the pressure in the furnace. Each winch drum 131 is mounted on a shaft 134 extending through a wall of housing 132 through known sealing means that prevents escape of gas past the shaft. Shaft 134 rigidly carries another winch drum 135 adapted to wind on and off of drum 135 another cable 136 that passes over idler pulleys 137 and winds on or off a third winch drum 138 driven by a sensing motor 139.

Sensing device 127 comprises a cable 141 extending longitudinally downward through bell rod 142 for distributor bell 71, which rod is made hollow for the purpose, a sensing member 143 being connected to the bottom end of the cable. A housing 144 is mounted on the top of bell rod 76 and rides up and down with it. The upper portion of cable 141 is wound on a winch drum 145 in housing 144. Drum 145 is fixed on a rotatable shaft 146 extending outside of and sealed to housing 144 and rigidly carrying winch drum 147 on which is wound and unwound a cable 148 adapted to wind on and off a winch drum 149 mounted on the shaft of a sensing motor 150.

In known manner the sensing members 128 and 143 are kept in upper out of the way locations as shown in full lines in FIG. 29 until it is desired to check the stockline level, when the members are lowered by suitable operation of their motors 139 and 150 until the members 128 and 143 contact the charge material in the furnace at the stockline, when the motors stop. Information as to the level of the material sensed by each member 128 and 143 is provided by the number of turns of the motors necessary to lower the members 128 and 143 to stockline sensing levels, in known manner. This information can be read out from conventional indicating means 151 and used to control the operation of the charging apparatus, including the distributing means, of any of the previous embodiments to provide charging and distribution of charge material to provide a stockline of desired height and shape, such as a substantially level stockline.

Figure 31:
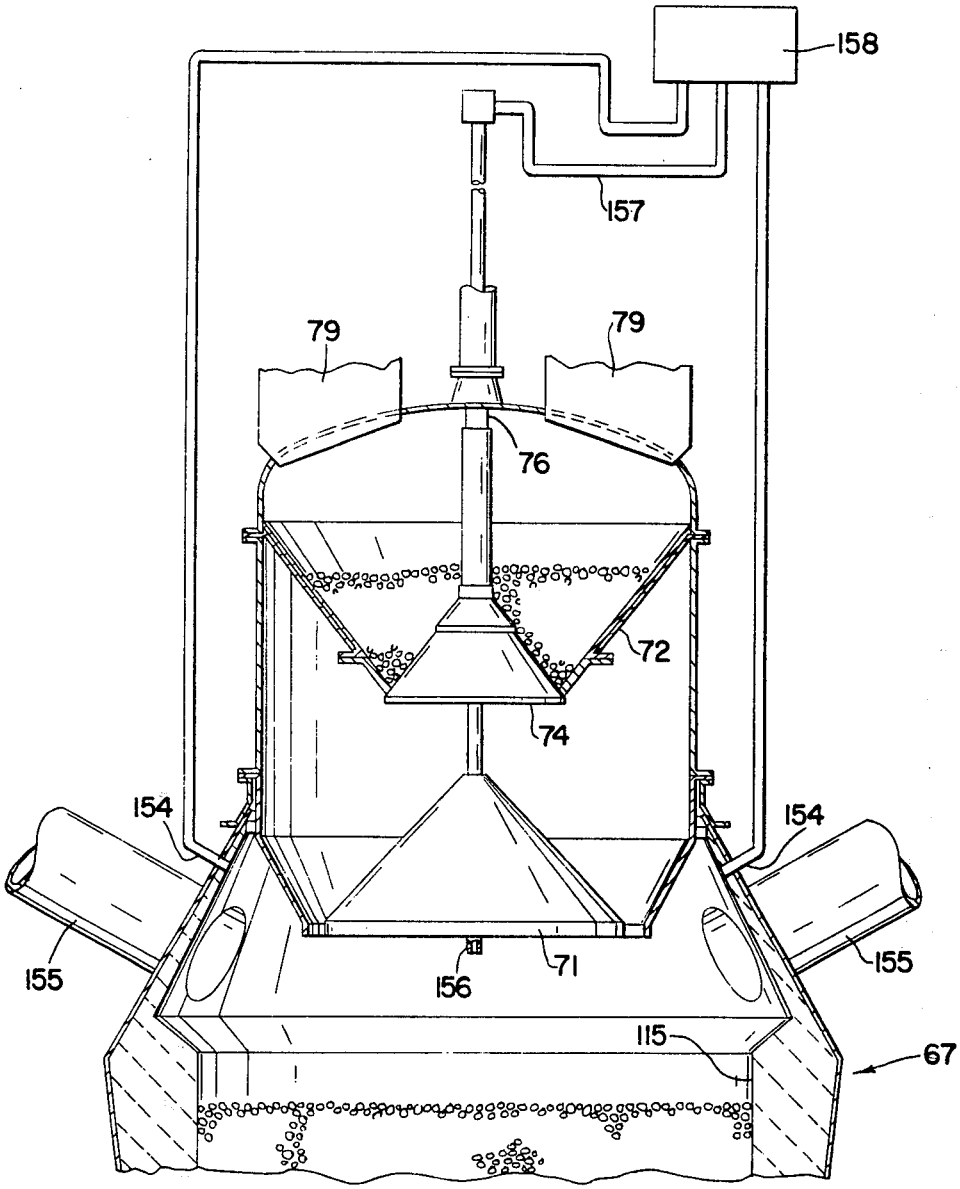
FIG. 31 illustrates different type of stockline level measuring means in which samples of gas from the periphery and central portion of the furnace above the stock line are tested.

FIG. 31 illustrates alternative means for testing the level and shape of the stockline as applied to furnace 67 of FIG. 19. In the apparatus of FIG. 31, parts identical to parts described in FIG. 19 bear the same reference characters, except as described below. In the embodiment of FIG. 31, samples of furnace gas are taken by pipes 154 at the periphery of the upper interior of the furnace preferably in the vicinity of the offtakes 155, of which there are usually four around the furnace. Samples of gas are also taken from the central portion of the furnace through the hollow bell rod 156 for the distributor bell 71. The gas samples from the peripheral pipes 154 and from the bell rod 156 and pipe 156 are tested by a known testing unit 158 for temperature, gas composition or analysis, or dust content, or any combination of these parameters, and from this information the level and shape of the stockline at the periphery and at the center of the furnace can be determined, and the operation of the charging apparatus including positioning or movement of the distributor bell in any of the embodiments of the invention can be controlled to provide a desired level and shape of stockline and movements of the distributor means adjusted accordingly.

Figure 32:
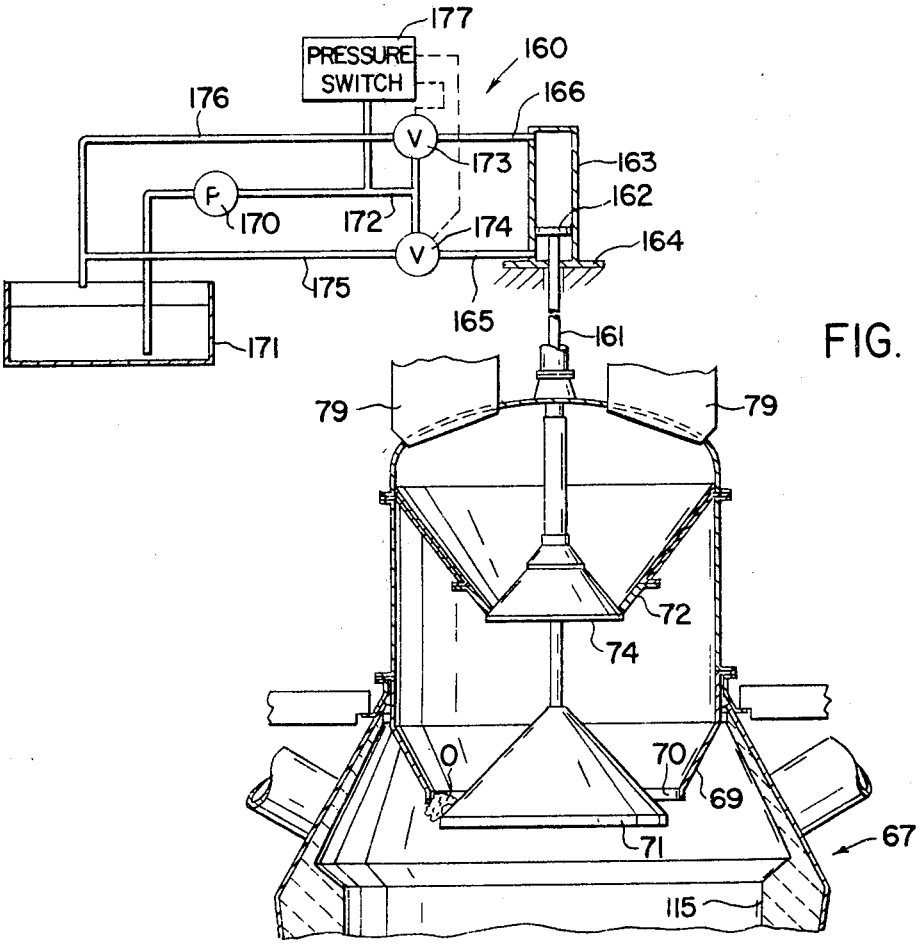
FIG. 32 illustrates means for reversing the movement of the distributor bell with respect to its hopper in the event an obstruction jams the bell.

FIG. 32 illustrates diagrammatically means 160 for reversing movement of the distributor bell in the event of jamming of the distributor bell, if large particles of charge or foreign material may get caught between the bell and its hopper, the furnace illustrated being like that of FIG. 19, although this means is applicable to all embodiments. This means includes, mounted at the top of the bell rod 161 for the distributor bell 71, a piston 162 movable in a cylinder 163 fixed to stationary frame 164 of the blast furnace. The piston is moved upward and downward to move the bell 71 upward and downward as required, by fluid such as hydraulic liquid that is supplied and exhausted through a conduit 165 at the rod end of the piston and conduit 166 at the blind end of the piston. Liquid under pressure is supplied through each of these conduits by pump 170 which draws liquid from sump 171 and supplies it to branched output conduit 172, the liquid being directed to each conduit as required by valves 173 and 174. The liquid is exhausted through conduits 165 or 166 by operation of such valves, which discharge exhausted liquid through conduits 175, 176 to the sump. A known type of pressure switch 177 senses the pressure in pump output conduit 172 and is connected by known means, diagrammatically indicated, to reverse the operation of valves 173, 174 if a pressure higher than a predetermined liquid pressure for which the pressure switch is set is exceeded on a stroke of the piston 162 that moves bell 71. For example, if bell 71 is moving upwardly and an obstruction 0 comes between bell 71 and opening 70 in hopper 69 substantially impedes or obstructs upward movement of the bell, the excessive pressure of the liquid developed in pump output conduit 172 will actuate the pressure switch and cause valves 173 and 174 automatically to change their settings so that the bell will move downwardly rather than upwardly. A similar situation will occur if the bell is moving downwardly and is similarly impeded or jammed, the pressure switch will cause the movement of the bell to reverse.

Figure 33:
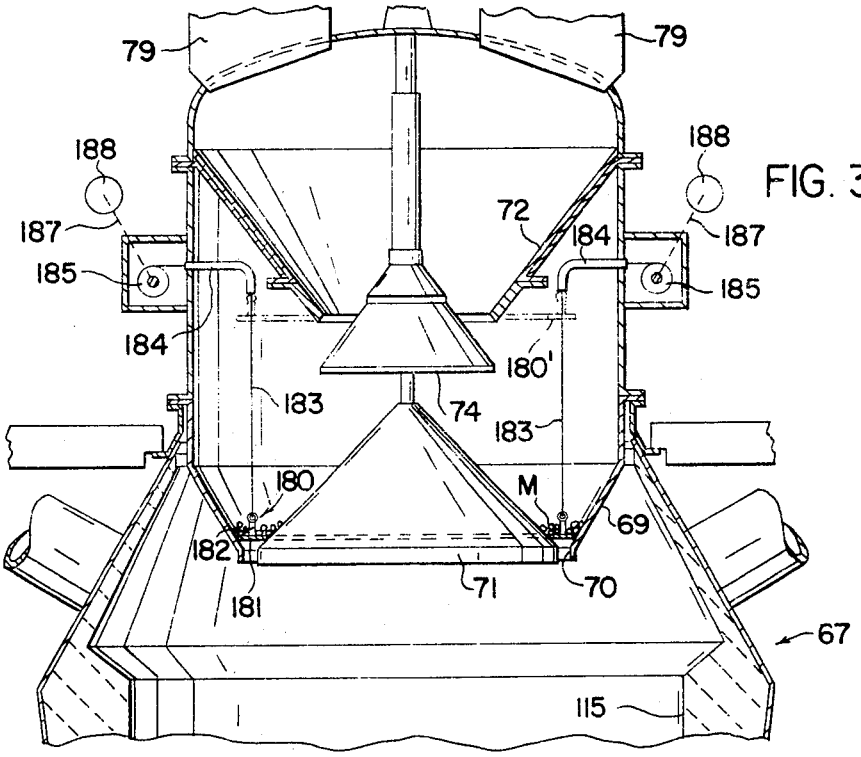
FIG. 33 illustrates an annular stopper member that is used when it is necessary for workmen to perform repairs or maintenance work within or above the distributing means.

FIG. 33 illustrates means that may be applied to any apparatus embodying the invention to make possible maintenance or repair work, in and above the distributor bell hopper, with no danger to workers, although there is a substantial space between the distributor bell and its hopper. For illustration, the blast furnace of FIG. 33 is similar to that of FIG. 19 except as described below.

In the apparatus of FIG. 33 an annular member 180 comprising a generally flat rigid portion 181 connected to a central vertically upstanding ring portion 182 is supported at a number of, at least three, equidistant points by cables 183 each of which passes through a tubular guide 184 extending through the upper furnace wall adapted to be wound on and unwound from a winch drum 185 located in a gas tight housing 186 into which an end of the tubular guide extends, so that each winch drum and its cable are at furnace pressure. Each winch drum is driven by a shaft 187 from suitable means such as a motor 188 outside of the housing, the rotatable shaft 187 extending through the housing and being sealed to it in gas tight relation. The winch drums 185 are rotated in unison in the same directions to raise or lower the annular member 180. Normally this member 180 is held in its uppermost position as shown in broken lines 180' where it clears other equipment in the furnace and material being charged into the furnace. However, when it is necessary or desirable to perform maintenance or repair above the bottom of the large hopper, then annular member 180 is lowered so that it bridges the lower portion of the space between the outside of the distributor bell and the inside of the hopper when the bell is positioned with its widest portion in the hopper opening 70. The flat portion 181 of member 180 is dimensioned so it will fit in this portion of the space, and the annular member as a whole is sufficiently flexible so that its portion 181 can tilt or otherwise adjust itself to contact the inside of the hopper and the outside of the bell substantially entirely around their circumferences, so as to substantially close off the space between the bell and the hopper. A suitable small amount of charge material M may then be dropped onto thus placed annular member 180 to form a gas seal between the bell and the hopper. Since the member 180 thus closes the space between the bell and the hopper in which workers might otherwise get caught, and since it makes possible the formation of a gas seal, it provides safety for workers performing maintenance or repair work in the portion of the furnace.

While in the above embodiments a rotating chute was shown as the means for depositing material into port means at the top of the furnace, and the gas valves of the port and a small bell and its hopper comprised the gas lock means, other means may be provided for providing a gas lock at the top of the furnace and for discharging material to a distributor member such as a bell which cooperates with a surrounding distributor member such as a hopper to distribute charge material as described above.

Thus, in FIG. 34 the blast furnace 190 has in its upper portion a stationary distributor hopper 191 the lower portion of which has an inclined wall 192 with an opening 193, and a distributor bell 194 the largest diameter of which at the bottom of the bell is sufficiently smaller in diameter than the hopper opening to permit the bell to be moved freely between positions above and below the hopper opening as shown in full and broken lines in FIG. 34. The bell is supported by bell rod 195 which is actuated by known means. The distributor hopper 191 and bell 194 may be similar to and be caused to cooperate as described above in any of the preceding embodiments.

The top wall 196 of the furnace has a plurality, preferably at least four, port means 197, each of which comprises a housing 198 and a passage 199 that is adapted to be closed by a gas sealing valve 201 that when closed seals the port means against escape of furnace gas and when opened clears the passage and permits unimpeded flow of charge material. Each valve 201 can be similar to, and actuated as, either of the port means gas sealing valves 38, 82 described previously.

A gas tight charging hopper 202 having an upper mouth 203 adapted to be closed gas tight by a valve 204 similar to valve 201, is mounted above each port means 197 by a gas tight connection. When closed, valve 204 prevents escape of furnace gas, and when open permits unimpeded flow of charge material into hopper 202.

Each hopper also has a material cut-off valve 205 above lower gas seal valve 201. Valve 205 comprises a closure gate member 206 movable in a gas tight housing 207 to extend across passage 199 to close the bottom of charging hopper 202 against passage of charging material, and when moved to another position in housing 207 opens passage 199 to permit free passage of charge material into the furnace, gas valve 201 being open. Valve 205 is actuated by a fluid cylinder 208.

Charge material is placed into each of charging hoppers 202 as required by suitable means such as a rotatable chute 210 shown as similar to chute 86 of apparatus of FIG. 19. This chute has an open top and a lower discharge opening 211 adapted to be aligned with the mouth of each of the charging hoppers as required, the hopper mouths being equidistant from axis A of the furnace about which the chute rotates. The discharge opening of the chute is adapted to be closed and opened as required by a gate 212 operated similar to and having operating means like that described above with FIG. 19. The chute is adapted to be supported and rotated by means like that described with FIG. 19, like parts having like reference numerals. Material is supplied to the chute by any suitable means, such as known conveyor belt assembly 213, although a skip car could be used to supply material to the chute in which case the chute could be like that of FIG. 1 with no gate for closing its discharge opening.

Figure 34:
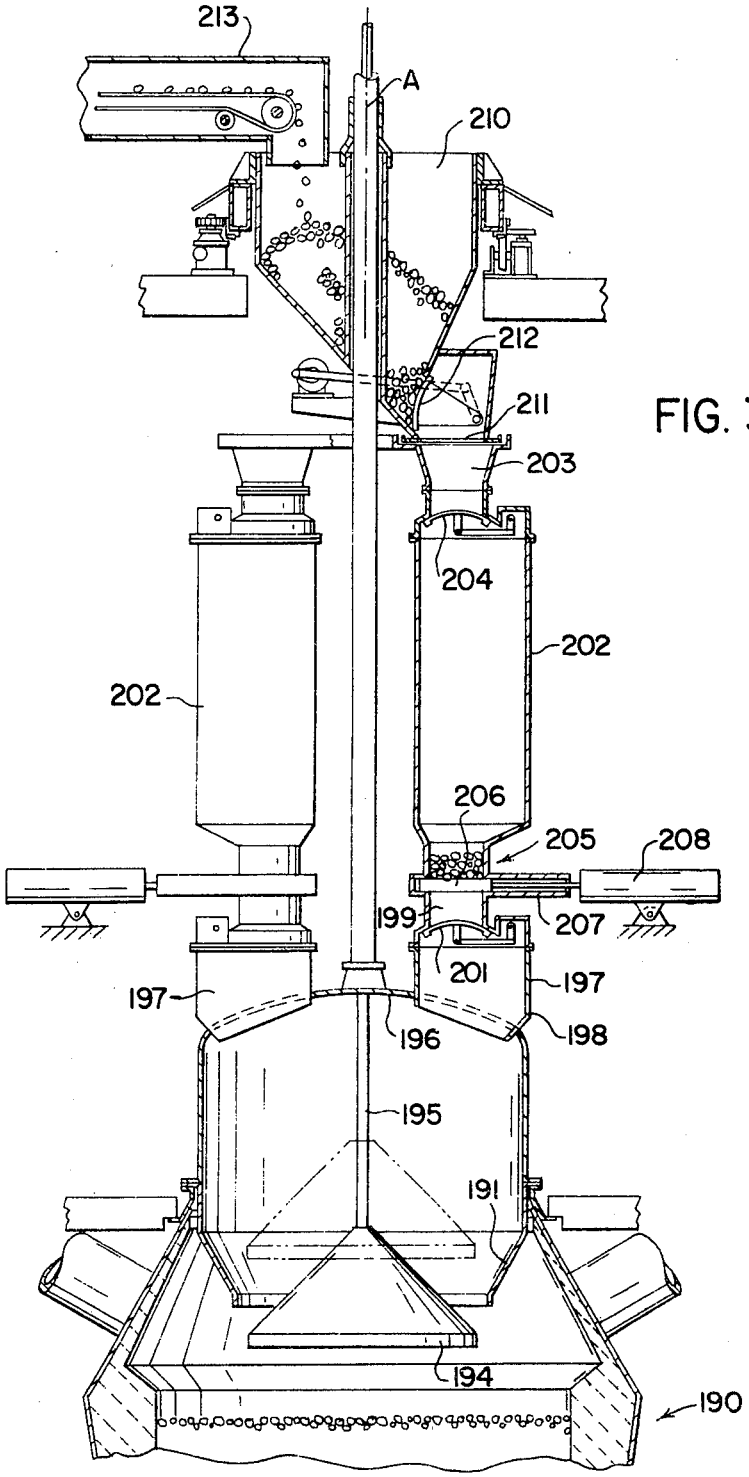
FIG. 34 illustrates another embodiment of the invention in which the distributor bell is movable between an elevated position inside of its hopper and the lower position with its lower edge below the hopper, and in which the gas lock means comprises hoppers each having gas valves at the top and bottom and a material holding gate at the bottom of each hopper.

In operation of the apparatus of FIG. 34, the lower gas sealing valves 201 for each charging hopper are maintained closed until opened for charging. The upper gas sealing valve 204 of a selected hopper is then opened and the rotatable chute 210 is turned until its discharge opening is aligned with the mouth 203 of the hopper. Gate 212 of the rotatable chute is then opened to discharge a predetermined amount of charge material into the selected hopper. After discharge has been halted, the upper gas sealing valve 204 is closed, the lower gas sealing valve 201 is then opened, and the material holding valve 205 is thereafter opened to discharge material into the furnace. Bell 194 and its hopper 191 are caused to cooperate as described above to effect desired distribution of charge material within the furnace and obtain a desired stock line shape. This cooperation may be as described in connection with FIGS. 1–17, 18, FIGS. 19–24, or FIGS. 25–28.

Each hopper 202 may be used individually to deposit material in the furnace, or all hoppers 202 may be filled and then used simultaneously to discharge material into the furnace while desired distribution is effected by the distributor bell and hopper.

Figure 35:
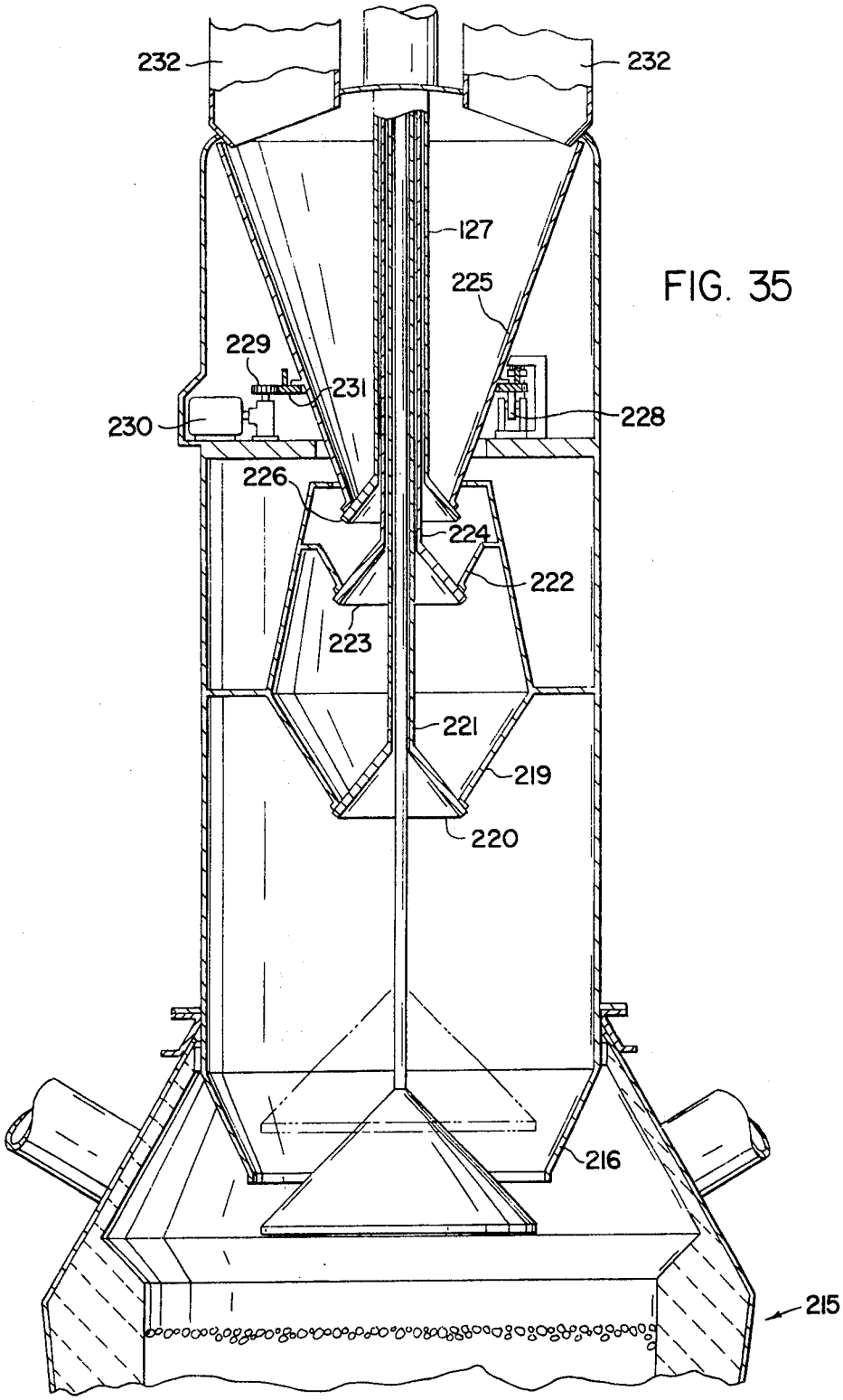
FIG. 35 illustrates another embodiment of the invention in which the gas lock means comprises two bells above the distributor bell and a rotatable bell hopper above the two bells.
Figure 36:
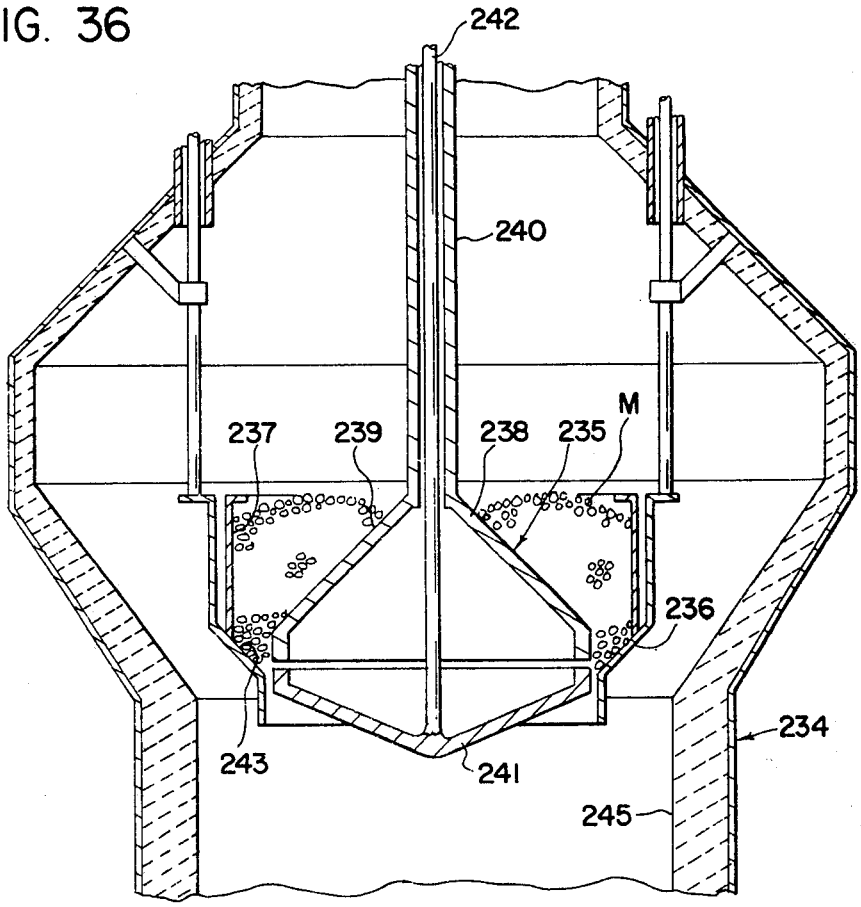
FIGS. 36–40 illustrate a modification of any of the preceding embodiments in which the distributor bell comprises an upper portion and a lower portion that cooperate to provide advantageous results.

Another embodiment of the invention, illustrated in FIG. 35, involves a different type of gas lock means in connection with any of the distributing bells and hoppers operated as previously described to distribute material in the furnace. In this embodiment blast furnace 215 has in its upper portion a stationary distributor hopper 216 and a vertically movable distributor bell 217 adapted to be operated as previously described. The bell is so moved by bell rod 218 operated by a known bell raising and lowering means not shown.

The upper portion of hopper 216 is formed by the lower portion of another superposed stationary hopper 219 adapted to be closed and opened by a smaller bell 220 that is adapted to be raised and lowered by tubular rod 221 actuated by known means not shown. The upper portion of hopper 219 is formed by the lower portion of another stationary hopper 222 that is opened and closed by another bell 223 adapted to be raised to close the hopper and lowered to open the hopper by tubular bell rod 224 operated by known means not shown.

A fourth hopper 225 is mounted above hopper 222. This hopper is rotatable but not sealed to the furnace; it has a bell 226, rotatable with the hopper, that can be raised and lowered as required to open and close the hopper by tubular bell rod 227, supported and operated by known means, not shown. Hopper 225 is supported for rotation by several, at least three, rollers 228 mounted on the furnace frame and is rotated by a gear 229, driven from suitable motor 230 which gear engages a ring gear 231 on the hopper. Rotatable hopper 225 is supplied with charge material as required by two ducts 232 which may be supplied by skip cars or conveyors or other suitable means. Suitable conduits and valves not shown but similar to those of FIGS. 12–17, may be provided for hopper 219 to relieve gas pressure in the hopper and repressurize it with clean gas, as required.

In operation, while bell 226 is closed, the desired amount of charge material is dropped into the rotatable hopper 225 from either or both ducts 232. The hopper is rotated to the desired predetermined angular location. While bells 220 and 226 close their respective hoppers and after gas pressure has been relieved in hopper 219, bell 223 is lowered, hopper 219 being at atmospheric pressure. Bell 226 is then lowered to discharge material from the rotatable hopper through hopper 222 and into hopper 219. Bells 226 and 223 are then raised to close their respective hoppers, hopper 219 is then brought to furnace pressure. Bell 220 is then lowered to permit charge material to drop onto the distributor hopper and bell 216 and 217 which can be caused to cooperate as described in any of the preceding embodiments to distribute the charge as desired in the furnace. The charge material may be introduced into hopper 225 to one side of the hopper or equally around the hopper, as is desired.

FIGS. 36–40 diagrammatically illustrate a portion of another blast furnace 234 embodying the invention, in which a distributor bell 235 may be operated relative to a distributor hopper 236 as disclosed in FIGS. 1–17, or FIG. 18, or FIGS. 19–24, or FIGS. 25–28. However, as illustrated, distributor bell 235 is operated as in FIGS. 1–17. In this case hopper 236 has a movable liner 237 to prevent sticking of charge material.

Bell 235 is a composite bell having an upper portion 238 with a frusto conical surface 239 that slopes upwardly and inwardly and is movable by tubular bell rod 240 and a lower portion 241 movable with or independently with respect to the upper portion by bell rod 242.

Figure 37:
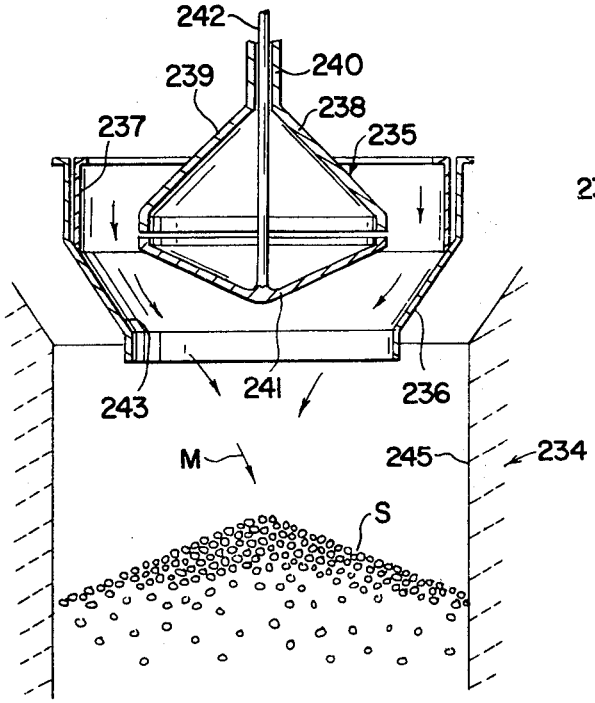

As shown in FIG. 37, the bell in its assembled form may be raised and charge material M (FIG. 36) equally circumferentially discharged onto the bell and its hopper through suitable gas lock means such as that of any of the preceding types of apparatus, is caused by the lower inclined portion 243 of the hopper to deflect inwardly of the furnace and build up a stockline S which is high in the center of the furnace.

Figure 38:
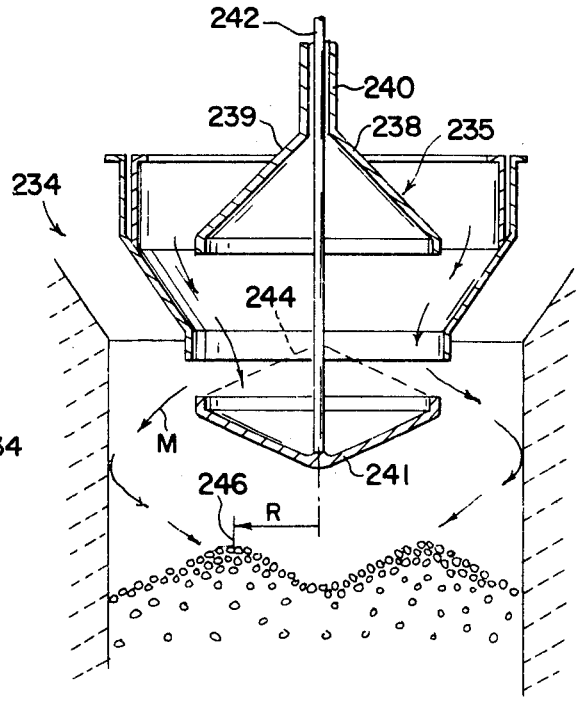

When, as in FIG. 38, the upper portion 238 of the bell is raised and the lower portion 241 is lowered, charge material M will build up a conical pile 244 on the lower portion 241, and thereby be deflected outwardly to strike inner furnace wall 245 and by it be deflected inwardly to form a stockpile S with a raised circumferential ridge 246 intermediate the center of the stockpile and the sides of the furnace. The peak of the ridge is spaced by a radius R less than the diameter of lower bell portion 241.

Figure 39:
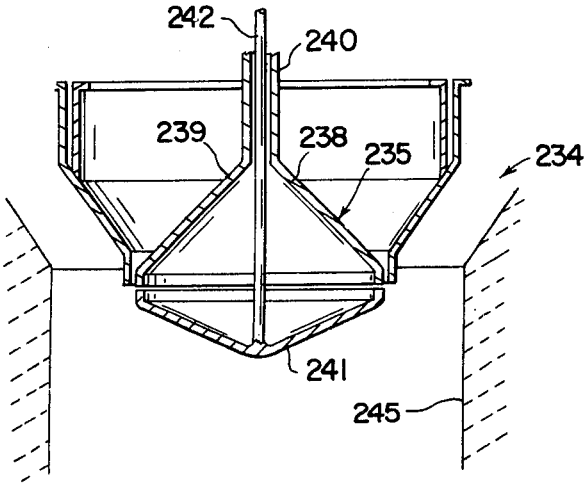
Figure 40:
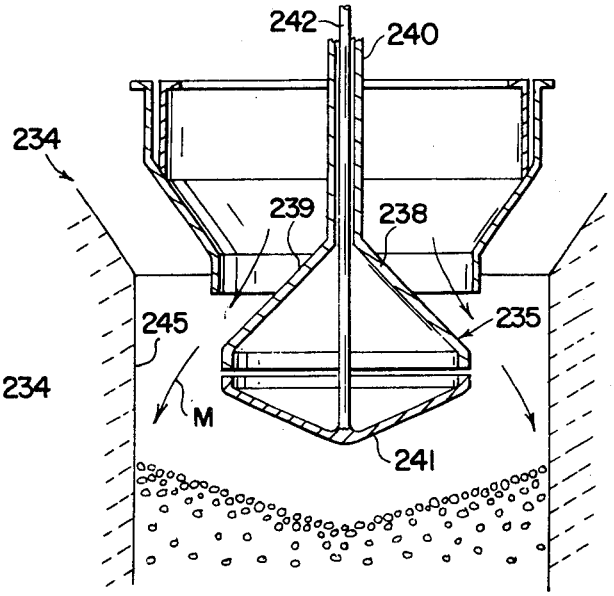

FIGS. 39 and 40 show that then the composite bell is positioned so that it is ready to move downwardly, and then is lowered, the stockline is built up toward the periphery of the walls of the furnace as previously described. By combinations of these features and modes of operation, any desired shape of the stock line within wide limits can be obtained.

Moreover, the composite bell of these figures can be used as described in connection with FIGS. 19 to 24 inclusive in which material is discharged as the bell is moving either from a lower position in which the bell is below the lower opening of its hopper to a higher position in which the bell is above the hopper or from such a higher position to a lower position; or as in FIGS. 25–29 in which the bell is stationary. The independently movable lower portion 241 of the bell thus makes it possible to achieve intermediate distributions which may be desirable in some cases.

In the above described embodiments, the slopes of the illustrated downwardly convergent inner surfaces of the hoppers are between about 45° and about 65° from the horizontal, and the slopes of the upwardly convergent surfaces of the bells are between about 40° and about 60° from the horizontal, which are preferable. In apparatuses according to FIGS. 19 and 25 particularly advantageous results have been obtained when the inner surface of the hopper has a slope of substantially 60° from the horizontal and the upper surface of the bell has a slope of substantially 45° from the horizontal; particularly desirable distribution patterns, even resulting in substantially level stocklines, have been achieved. In general it is beneficial if the inner surface of the outer distributor member or hopper has a steeper slope than that of the upper surface of the inner distributor member or bell.

Various modifications may be made in the disclosed embodiments.

Thus, the embodiment of FIGS. 25–28 and its mode of operation may be modified by providing a skirt portion on the distributor hopper 117 at its lower perimeter defined by the opening 122 and no skirt portion at the largest perimeter at the bottom of distributor bell 120, and by discharging particulate material so that it passes generally parallel to the inclined upper surface of the bell. By proper offset location of the bottom perimeter of the bell and the surrounding skirt portion of the hopper relative to each other, it is possible to achieve results similar to those disclosed in FIG. 26 of having particulate material pass toward the wall of the furnace and also toward the center of the furnace; or results similar to those of FIG. 28 in which substantially all the material will be discharged toward the wall of the furnace if the bell is lowered so its upper surface substantially clears the skirt portion, or a result similar to that shown in FIG. 27 in which substantially all the material will be deflected toward the center of the furnace by the skirt portion if the botom of the bell is somewhat raised relative to the skirt portion.

Furthermore, each of the above described distributor means can be used in a furnace having any of the above described gas lock means, or with other types of gas lock means. The anti-jamming means disclosed in connection with FIG. 32 can be used in any of the embodiments, as can the stockline shape sensing means disclosed in connection with FIGS. 33 and 34.

Other modifications other than those illustrated above may be made.

The present invention thus provides an apparatus for charging material into a shaft furnace, such as a blast furnace, which makes possible distribution of the material in the furnace to achieve the stockline of any desired shape within wide limits, by use of only a very few moving parts which are simple and rugged in construction so that they do not deteriorate even over long service, and so that they require little maintenance. Such desired distribution can be achieved even in furnaces of large size that require high rates of charging of material into the furnace and having a large diameter over which charge material must be properly distributed. Moreover, the apparatus of the invention makes possible operation at top pressures as high as any used now or in the foreseeable future.

The means of the invention for sensing the levels and shape of the stockline provides information to control the charge distributing means to achieve the desired efficient stockline shape. The invention also makes possible means for carrying out maintenance work in the furnace although the distributor bell does not seal against gas pressure. Moreover, since the distributor bell is never used as a gas seal valve, there are no problems of sealing around its large perimeter or of resisting forces caused by high gas pressures over a large bell, as would otherwise occur in large furnaces. Furthermore, there is no problem of gas erosion of a large bell since the distributor bell is at all times exposed to the gas furnace pressure.

The means provided by the present invention for making possible desired distribution of charge material to provide a desired stockline shape thus makes possible desired gas distribution in the furnace to achieve stable furnace operation, efficient utilization of gas and fuel, and efficient furnace operation.

Other advantages of the invention will be apparent to those skilled in the art.

While the invention has been disclosed above as used in blast furnaces, the invention may be used in other types of shaft furnaces, such as lime kilns and oil shale retorts.

Various modifications apparent to those skilled in the art in addition to those indicated above may be made in the apparatus and processes disclosed above, and changes may be made with respect to the features disclosed, provided that the elements set forth in any of the following claims or the equivalent to such be employed.

What is claimed is:

1. Apparatus for charging particulate material into a receptacle to form a stockline in the receptacle, said apparatus comprising an inner wall of the receptacle defining a zone in which said stockline is to be located; distributor means for distributing particulate material in said receptacle to form said stockline comprising a bell in said receptacle and a member surrounding said bell, said member having a bottom opening into which at least a portion of said bell may extend during operation of said distributor means; means for causing relative movement between said bell and said surrounding member during the distributing operation; means for determining the configuration of said stockline comprising means for sensing the level of said stockline at a plurality of locations thereon near said inner wall of said receptacle and at a location substantially at the center of said stockline and beneath said bell, and means associated with said sensing means for indicating outside of said receptacle the level of the stockline in each of said locations to permit operation of said charging apparatus including said distributor means to be controlled to discharge particulate material to correct undesired deviations in the level of said stockline.

2. The apparatus of claim 51 in which said bell is supported by a bell rod, and said means associated with said sensing means beneath said bell operates through said bell rod to indicate outside of said receptacle the level of the stockline sensed by said sensing means beneath said bell.

3. The apparatus of claim 2 in which each of said means for sensing the level of the stockline near the inner wall of said receptacle comprises a weighted member supported by a cable, winch means for unwinding said cable as it rotates in one direction and for winding on said cable as it rotates in the other direction, means for rotating said winch means, and means associated with said rotating means for determining the elevation of said stockline at a location at which said weighted member contacts said stockline when it is lowered; and said means for sensing the level of said stockline below said bell comprises a weighted member below said bell supported by a cable extending through said bell rod, winch means mounted on said bell rod, said winch means being adapted to lower said weighted member when it is rotated in one direction and to raise said weighted member when it is rotated in the other direction, means for rotating said winch means, and means associated with said rotating means for determining the level of the stockline at the location where it is contacted by said weighted member when it is lowered.

4. The apparatus of claim 2 in which said means for sensing the level of the stockline near said inner wall, and said means operative through said bell rod of said bell for sensing the level of the stockline below the bell, comprise conduit means opening into said receptacle for removing gas samples at said locations, and means associated with said conduit means for determining a characteristic of each of said gas samples, whereby from information as to such characteristic the shape of the stockline can be determined.

5. The apparatus of claim 4 in which said last mentioned means determines such characteristic outside of said receptacle.

6. The apparatus of claim 4 in which said last-mentioned means includes means for determining the temperature of each of said gas samples.

7. The apparatus of claim 4 in which said last-mentioned means includes means for determining the composition of each of said gas samples.

8. The apparatus of claim 4 in which said last-mentioned means includes means for determining the dust content of each of said gas samples.

9. Apparatus for charging particulate material into a shaft furnace in which a substantial pressure of gas is maintained during operation of said furnace, comprising a furnace portion having an inner furnace wall defining a space into which said material is to be deposited to form a stockline in the furnace; gas lock means permitting introduction of said material into the upper portion of said space without harmful loss of gas pressure; distributor means in said space below and gas lock means comprising a distributor bell having an upper surface that converges upwardly and inwardly from a perimeter of said bell at the lower edge of said upper surface, said perimeter being the largest perimeter of said bell, a distributor hopper surrounding said bell and having an inner surface that converges downwardly and inwardly said hopper having an opening adjacent the lower edge of said inner surface through which said bell may freely pass, the edge of said opening being in close proximity to and spaced from said perimeter of said bell when said perimeter is in said opening, and means for relatively positioning said bell and said hopper along an upright path between a position in which said bell perimeter is located in a lower position relative to said hopper opening so said particulate material is directed by the upper surface of said bell through said opening towards said inner furnace wall and a position in which said bell perimeter is in an upper position relative to said hopper opening so that particulate material is directed by the inner surface of said hopper toward a location below the bell and toward the central portion of the stockline away from said inner furnace wall; means for sensing the level of material in said furnace at a plurality of locations near said inner furnace wall and at a location substantially at the center of said furnace beneath said bell; and means outside of said furnace for receiving information from said sensing means as to the level of the stockline at each of said locations, to permit use of such information in causing relative positioning of said bell and said hopper to achieve a desired stockline configuration in said furnace.

10. The apparatus of claim 9 in which said bell is supported by a bell rod, and said sensing means beneath said bell operates through said bell rod.

11. The apparatus of claim 9 in which said gas lock means comprises a plurality of spaced port means at the top of said furnace, each of said port means having valves means that can be closed to prevent escape of gas from the furnace, and that can be individually opened to permit particulate material to enter the furnace through said opened port means, said port means being adapted to be individually opened at selected locations and said bell and distributor hopper being adapted to be relatively selectively positioned on the basis of information received from sensing means, to achieve a desired stockline configuration.

12. Apparatus for charging particulate material into a shaft furnace in which a substantial pressure of gas is maintained during operation of said furnace, comprising a furnace portion having an inner furnace wall defining a space into which said material is to be deposited to form a stockline in the furnace; gas lock means permitting introduction of said material into the upper portion of said space without harmful loss of gas pressure said gas lock means comprising a plurality of spaced port means at the top of said furnace, said port means each having valve means that can be closed to prevent escape of gas from the furnace and that can be individually opened to permit particulate material to enter the furnace through the opened port means; distributor means for distributing particulate material in said furnace comprising a bell in said furnace and a member surrounding said bell, said member having a bottom opening into which at least a portion of said bell may extend during operation of said distributor means, means for causing relative movement between said bell and said surrounding member during the distributing operation; means for determining the configuration of said stockline comprising means for sensing the level of said stockline at a plurality of locations thereon near said inner furnace wall and at a location substantially at the center of said stockline and beneath said bell; and means outside of said furnace for receiving information as to the level of said stockline at each of said locations, whereby said information can be utilized to open a desired port means and operate said distributor means to achieve adesired stockline configuration, said port means being adapted to be individually opened at selected locations, on the basis of information received from said sensing means, to achieve a desired stockline configuration.

13. A process for charging particulate material into a receptacle comprising an inner wall defining a zone in which a stockline is to be located and distributor means for distributing particulate material in said receptacle to form said stockline comprising a bell in said receptacle and a member surrounding said receptacle, said member having a bottom opening into which at least a portion of said bell may extend during operation of said distributor means and means for causing relative movement between said bell and said surrounding member during the distributing operation, said process comprising the steps of sensing the level of the stockline at a plurality of locations thereon near the inner wall of said receptacle and at a location substantially at the center of said stockline and beneath said bell, receiving outside of the receptacle the information as to the stockline level at each of said locations, and controlling the operation of said distributor means for distributing particulate material to achieve a desired stockline configuration on the basis of information received from said sensing means.

14. The process of claim 13 in which said step of sensing the level of the stockline at said plurality of locations is accomplished by physically contacting the stockline at each of said locations.

15. The process of claim 13 in which said step of sensing the level of the stockline at said plurality of locations comprises taking a sample of gas emanating from the stockline at each of said locations, conducting the gas outside of said receptacle and analyzing the gas to determine a characteristic that indicates the level of said stockline at the location.

* * * * *